US006423941B1

(12) United States Patent
Kanari et al.

(10) Patent No.: US 6,423,941 B1
(45) Date of Patent: Jul. 23, 2002

(54) IMAGE HEATING APPARATUS AND HEATER

(75) Inventors: Kenji Kanari, Numazu; Masahiro Goto; Masami Takeda, both of Mishima; Toshio Miyamoto; Masahiko Suzumi, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,355

(22) Filed: Aug. 23, 1999

(30) Foreign Application Priority Data

Aug. 31, 1998 (JP) ..... 10-262466
Jan. 13, 1999 (JP) ..... 11-006223

(51) Int. Cl.[7] ..... H05B 1/00

(52) U.S. Cl. ..... 219/216; 219/469; 219/470; 399/330; 432/60

(58) Field of Search ..... 219/216, 469–471; 399/330–335; 432/60, 228; 492/46; 118/60

(56) References Cited

U.S. PATENT DOCUMENTS 5,171,969 A 12/1992 Nishimura et al. ..... 219/216
5,376,773 A * 12/1994 Masuda et al. ..... 219/543
5,822,670 A * 10/1998 Morigami ..... 399/334
6,049,064 A * 4/2000 Natsuhara et al. ..... 219/216
6,091,059 A * 7/2000 Sato et al. ..... 219/469

FOREIGN PATENT DOCUMENTS

| | | |
|---|---|---|
| EP | 0 773 485 A2 | 5/1997 |
| JP | 63-313182 | 12/1988 |
| JP | 2-157878 | 6/1990 |
| JP | 4-44075 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 06-282188 | 10/1994 |
| JP | 06-337605 | 12/1994 |
| JP | 07-199702 | 8/1995 |
| JP | 10-133502 | 5/1998 |

* cited by examiner

*Primary Examiner*—Teresa Walberg
*Assistant Examiner*—Shawntina Fuqua
(74) *Attorney, Agent, or Firm*—Fitzpatrick, Cella, Harper & Scinto

(57) ABSTRACT

The present invention relates to an image heating apparatus in which an image on a recording material is heated by heat from a heater via a film, and the film contacts a surface of the heater opposite to a surface thereof on which heat generating members are provided.

18 Claims, 16 Drawing Sheets

IMAGE HEATING APPARATUS AND HEATER

BACKGROUND OF THE INVENTION

1. Field of the Invention

The present invention relates to an image heating apparatus adapted for use in an image forming apparatus such as a copying machine or a printer, and a heater adapted for use in such image heating apparatus.

2. Related Background Art

For heat fixing apparatus, there have been employed the heat roller fixing method based on contact heating satisfactory in heat efficiency and safety, and the film heating method capable of energy saving.

The heat fixing apparatus of the heat roller fixing type is basically composed of a heating roller (fixing roller) serving as a heating rotary member and an elastic pressure roller maintained in pressure contact therewith and serving as a pressurizing rotary member. Such paired rollers are rotated, and a recording material (a transfer material sheet, an electrostatic recording sheet, an electrofax paper or a printing sheet or the like) bearing an unfixed image (toner image) is introduced into and pinched, converged and passed by the nip of the paired rollers, whereby the unfixed image is fixed with heat and pressure as a permanent image on the recording material by the heat from the heating roller and the pressure from the elastic pressure roller at the nip.

Also the heat fixing apparatus of the film heating method is disclosed for example in the Japanese Patent Application Laid-Open Nos. 63-313182, 2-157878, 4-44075 to 4-44083, 4-204980 to 4-204984 and the like. A heat-resistant fixing film (fixing film) constituting a heating rotary member is slid frictionally and conveyed in contact with a heating member by means of a pressing rotary member (elastic roller), and a recording material (hereinafter also called transfer material) bearing an unfixed image is introduced into the close contacting nip formed by the heating member and the pressing rotary member across the heat-resistant fixing film and conveyed together with the heat-resistant fixing film. Thus the unfixed image is fixed as a permanent image on the transfer material by the heat transferred from the heating member through the heat-resistant film and the pressure from the pressurizing rotary member at the close contacting nip.

The heat fixing apparatus of the film heating method can save electric power consumption and can achieve a shortened waiting time (quick starting) since it can employ a linear heating member of a low heat capacity and a thin film of a low heat capacity.

However, in the conventional heat fixing apparatus of the film heating method described above, heat conductivity in a direction (hereinafter called longitudinal direction) perpendicular to the conveying direction of the recording material is poor because the heater constituting the heating member and the fixing film constituting the heating rotary member are both small in heat capacity. Consequently, in case of passing a recording material of a width smaller than the maximum size, there tends to result a significant temperature increase in a non-passing area of the recording material, leading to thermal damage to a supporting member for the heater, the film, the pressure roller etc. In order to prevent such thermal damage, it has therefore been necessary to decrease the throughput of the smaller-sized sheet.

Also in case of passing a wide recording sheet immediately after passing a smaller recording sheet, the hot offset phenomenon tends to occur in the non-passing area of the smaller recording sheet because the heater and the pressure roller are at a higher temperature only in such non-passing area. In order to prevent such phenomenon, it has been necessary to provide a pause time after passing the smaller-sized sheet, prior to the passing of the wide recording sheet.

In order to prevent such phenomenon, it has been proposed to divide the heat generating member of the heater into plural patterns and to vary the heat generating area according to the width of the recording material, but such method has not been practiced because of the following drawbacks.

In case of passing a narrow recording material, the temperature on the ceramic substrate becomes abruptly higher in the non-passing area immediately outside the sheet passing area. Therefore, in order to accommodate recording materials of various widths, it becomes necessary to independently control the power supply to the heat generating members of many kinds. Thus there are required a number of contact electrodes corresponding to the independent heat generating members, whereby the heater becomes not only extremely bulky but also the driving circuits for driving the heat generating members are required in an excessively large number and become unacceptably costly.

Also, in the heat fixing apparatus of the film heating method, the heat generating member has to be made wide in order to secure the sufficiently wide heat transmitting area, corresponding to the increasing process speed of the image forming apparatus. For this reason, in order to independently drive many heat generating members corresponding to various sizes of the recording material, the required substrate size increases with the increase of the process speed, thus resulting in an unacceptably high cost.

Also the heat generating member, having a shorter heat generating portion corresponding to a smaller-sized sheet, tends to show a large current because of the reduced resistance, thus eventually resulting a flickering phenomenon.

SUMMARY OF THE INVENTION

An object of the present invention is to provide an image heating apparatus capable of preventing the temperature increase in the sheet non-passing area without an excessive increase in the number of the heat generating members, the electrodes or the like.

Another object of the present invention is to provide an image heating apparatus and a heater capable of preventing the flickering phenomenon even when a small-sized recording material is used.

Still another object of the present invention is to provide an image heating apparatus comprising a heater having plural heat generating members provided on a long-shaped ceramic substrate and adapted for generating heat by means of a power supply and a film to be contacted with a recording material bearing an image thereon, wherein the plural heat generating members have different distributions of generated heat in the longitudinal direction of the substrate, and the film contacts a face of the heater opposite to the face thereof bearing the heat generating members, whereby the image on the recording material is heated by the heat from the heater via the film.

Still another object of the present invention is to provide an image heating apparatus comprising a heater having plural heat generating members provided on a long-shaped substrate and adapted for generating heat by means of a power supply and a film to be contacted with a recording material bearing an image thereon, wherein the plural heat generating members have different distributions of generated heat in the longitudinal direction of the substrate, and the heater has a high heat-conductive (thermal conductive) member provided on the heat generating members and the film contacts the high heat-conductive member whereby the image on the recording material is heated by the heat from the heater via the film.

Still another object of the present invention is to provide a heater comprising a long-shaped substrate, and first and second heat generating members provided on the substrate along the longitudinal direction thereof and adapted to generate heat by means of a power supply, wherein the length of the second heat generating member in the longitudinal direction of the substrate is smaller than that of the first heat generating member and the resistance value per unit length of the second heat generating member in the longitudinal direction of the substrate is larger than that of the first heat generating member, and an image heating apparatus provided with such heater.

Still other objects of the present invention, and the features thereof, will become fully apparent from the following description.

DETAILED DESCRIPTION OF THE PREFERRED EMBODIMENTS

Now the present invention will be clarified in detail by preferred embodiments thereof, with reference to the attached drawings.

Figure 9:
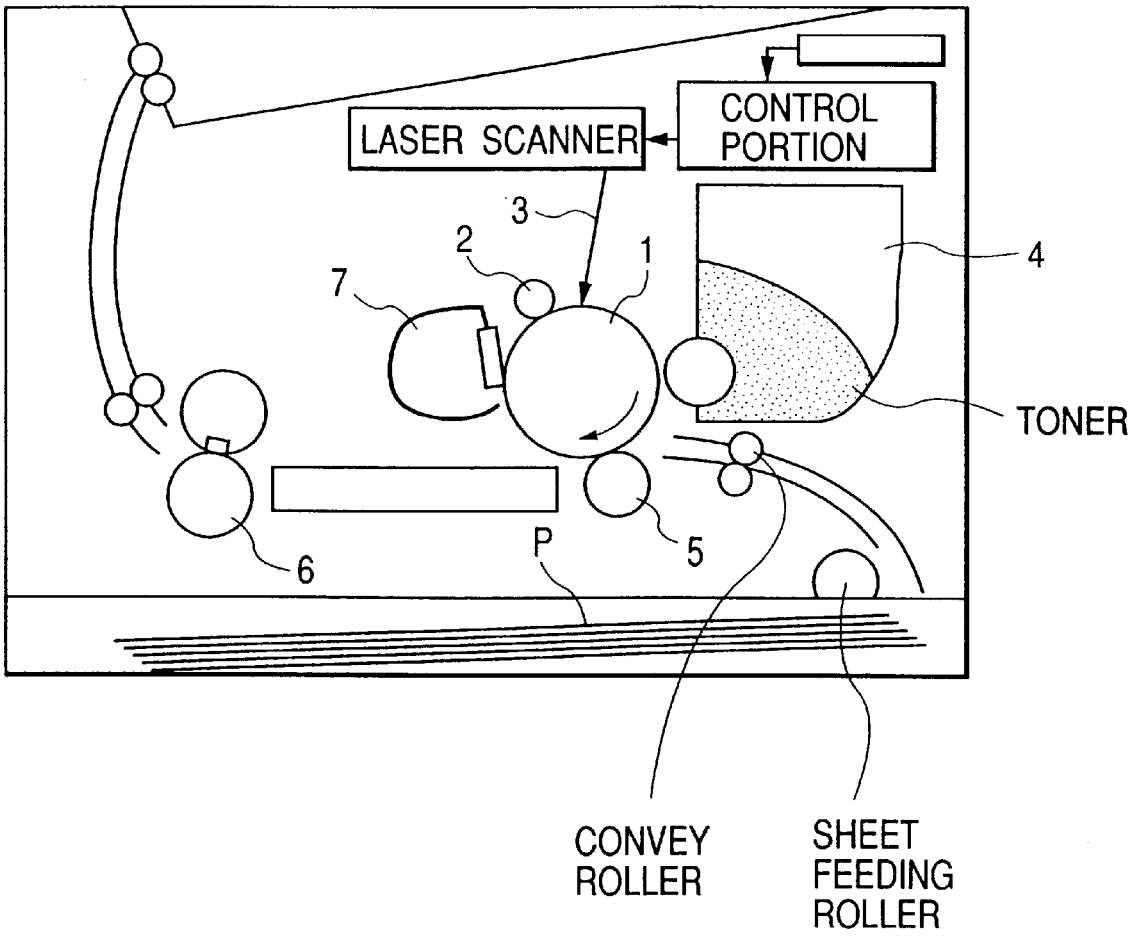
FIG. 9 is a view showing an image forming apparatus in which the present invention is applicable.

FIG. 9 shows an image forming apparatus in which the present invention is applicable. A photosensitive drum 1 is composed of a photosensitive material such as an organic photoconductor (OPC), amorphous Se or amorphous Si formed on a cylindrical substrate such as of aluminum or nickel. The photosensitive drum 1 is rotated in a direction indicated by an arrow, and the surface thereof is uniformly charged by a charging roller 2 constituting a charging device. Then a laser beam 3 constituting the exposure means is on/off controlled according to the image information and scans the surface to form an electrostatic latent image on the photosensitive drum 1. The electrostatic latent image is visualized by development in a developing device 4. The development may be conducted for example by jumping development or two-component development, and a combination of image exposure and reversal development is often employed. The visualized toner image thus obtained is transferred, by means of a transfer roller 5 constituting the transfer device, from the photosensitive drum 1 onto a recording material P fed and conveyed at a predetermined timing, and the above-described configuration constitutes image forming means. The recording material P bearing the toner image is conveyed to a heat fixing apparatus 6, and the toner image is fixed as a permanent image on the recording material, by the heat and pressure given in the nip of the heat fixing apparatus 6. On the other hand, the toner remaining on the photosensitive drum 1 is removed therefrom by a cleaning device 7.

Figure 1:
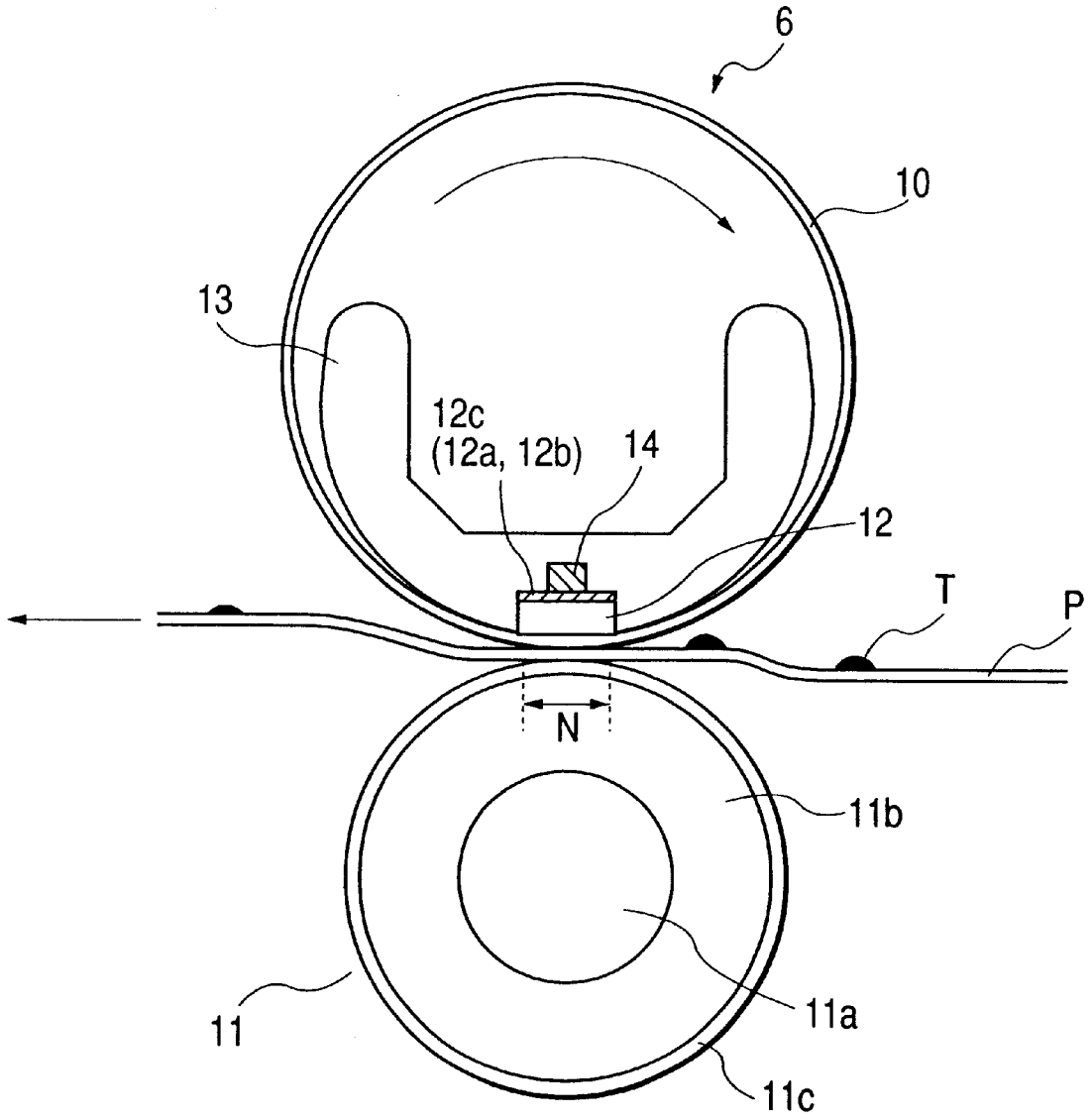
FIG. 1 is a view showing an embodiment of the image heating apparatus of the present invention.

FIG. 1 is a schematic cross-sectional view of a heat fixing apparatus as an image heating apparatus of a film heating method, constituting an embodiment of the present invention, wherein a film (fixing film) 10 of an endless belt shape is loosely fitted on a semi-circular film guide member (stay) 13. In order to reduce the heat capacity and to improve the quick starting property, the film 10 uses a film composed of heat-resistant resin such as polyimide or PEEK with a total thickness not exceeding 100 $\mu$m, preferably within a range from 60 to 20 $\mu$m.

A pressure roller 11, constituting a pressurizing rotary member, is provided, on a metal core 11*a* such as of iron or aluminum, with a silicone rubber layer 11*b* and a releasing PFA tube layer 11*c* thereon.

The film 10 is rotated clockwise as indicated by an arrow and without crease, by the rotation of the pressure roller 11, in contact with and sliding over the heater surface of a heater 12 at least in the course of image fixing, at a peripheral speed substantially the same as the conveying speed of the recording material P which is conveyed from the image forming unit (not shown) and bears the unfixed toner image T thereon.

The heater 12 includes heat generating members (heat generating resistors) 12*a*, 12*b* as the sources of heat generation by means of a electric power supply, and shows a temperature rise due to the heat generation by the heat generating members 12*a*, 12*b*. In the course of passing of the recording material P through the fixing nip, thermal energy is given from the heater 12 through the film 10 to the recording material P whereby the unfixed toner image T thereon is heated, fused and fixed. After passing the fixing nip, the recording material P is separated from the fixing film 10 and discharged. The fixing film 10 employed in the heat fixing apparatus of the present embodiment is obtained by coating polyimide varnish with a predetermined thickness on a cylindrical surface, then thermally setting the varnish and thereon coating and sintering PFA, PTFE or a mixture thereof. In the present embodiment, polyimide of a thickness of 50 $\mu$m was employed as the film substrate with a PFA layer of a thickness of 10 μm thereon, with an internal diameter of 25 mm.

The pressure roller 11 is formed by roughening the surface of the metal core 11*a* such as of iron or aluminum for example by blasting, then rinsing the surface, inserting the metal core 11*a* into a cylindrical mold, injecting and thermally setting liquid silicone rubber in the mold. In this operation, in order to form the releasing resin tube layer 11*c* such as of PFA tube on the surface of the pressure roller, a tube coated with primer therein is in advance inserted in the mold whereby the tube and the rubber layer 11*b* are adhered simultaneous with the thermal setting of the rubber. The pressure roller 11 thus formed is separated from the mold and is subjected to secondary vulcanization. In the present embodiment, the pressure roller 11 was composed of an aluminum core with a diameter of 14 mm, a rubber layer of a thickness of 4 mm and a tube layer of a thickness of 50 μm, with an external diameter of about 22 mm.

The heater 12 is provided, on the upper surface of a long-shaped substrate 12*d*, with the heat generating members 12*a*, 12*b*, a glass coating layer 12*c* and a temperature detecting element 14, and a rear surface heater in which the rear surface of the substrate (namely, a surface of the substrate, which is opposite to the surface thereof provided with the heat generating members) abuts against the fixing nip. Such configuration provides thermal conduction comparable to that in the conventional heat generating member with a glass coating thereon (thermal conductivity of $Al_2O_3$ substrate being about 10 times of that of glass; $Al_2O_3$ of a thickness of 0.65 mm and glass coating of a thickness of about 50 to 70 μm providing comparable thermal conduction).

Also the larger distance from the heat generating members to the nip surface in comparison with the conventional configuration increases heat diffusion in the heater substrate, thus allowing reduction of the spreading of the width of the heat generating member required corresponding to the process speed of the image forming apparatus. Also for similar reasons, the temperature distribution in the longitudinal direction is rendered more uniform, whereby the excessive temperature rise in the paper non-passing area encountered in case of continuous passing of small-sized sheets can be relaxed.

Figure 2:
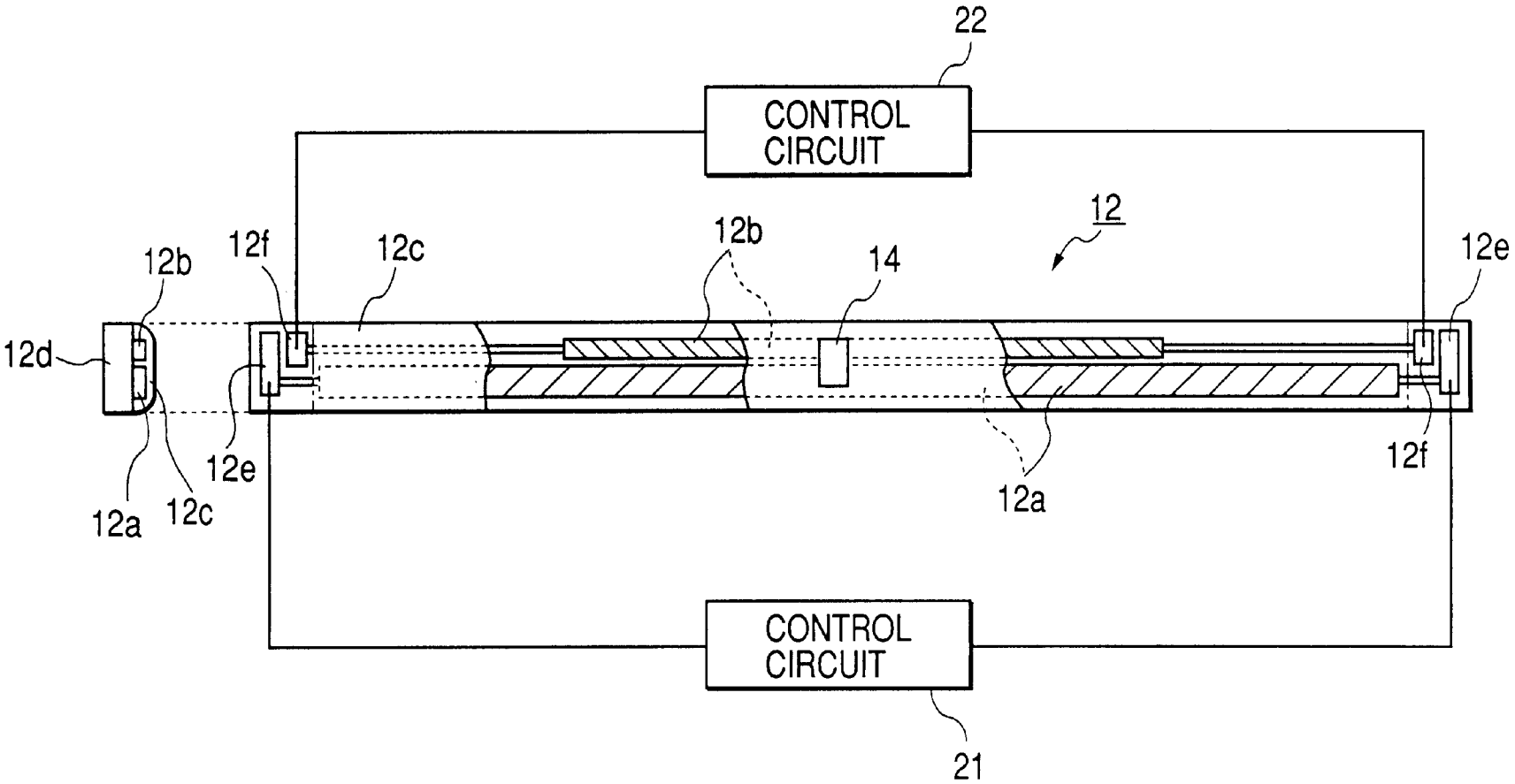
FIG. 2 is a view showing the arrangement of heat generating members on the heater.

FIG. 2 shows the arrangement of the heat generating members on the heater substrate. In the present embodiment, two heat generating members, namely a heat generating member 12*a* for the wide recording material and a heat generating member 12*b* for the narrow recording material are independently controlled according to the width of the recording material. The heat generating members 12*a*, 12*b* formed on an $Al_2O_3$ (alumina) substrate with the pattern shown in FIG. 2 is obtained by thick film printing and firing of Ag/Pd paste, and a glass coating layer 12*c* is formed thereon with a thickness of 30 to 50 μm. The heat generating member 12*a* generates heat by a voltage application between electrodes 12*e*, while the heat generating member 12*b* generates heat by a voltage application between electrodes 12*f*.

On the other hand, the substrate surface opposite to the heat generating members is made smooth by surface lapping or by forming a thin glass coating of a thickness not exceeding 15 μm, in order to improve the slidability of the film 10. A thermistor 14 (temperature detecting element) is maintained in contact, across heat-resistant insulating resin or a ceramic substrate, with the glass layer on the heat generating member by unrepresented pressurizing spring means in an area where the heat generating members 12*a*, 12*b* are both present (area passed by the smallest-sized recording sheet), and controls the power supply to either heat generating member according to the information of the size of the recording sheet.

In the present embodiment, the sensor is provided in a position slightly outside the width of the heat generating member 12*b* in the conveying path, and the heat generating member to be powered is selected according to the signal from the sensor. More specifically, the maximum width of the recording material is selected as the letter size (216 mm), and the slightly narrower recording sheets of A4 size (210 mm) and B5 size (182 mm) are fixed with the power control of the heat generating member 12*a*. On the other hand, the sheet of A5 size (148 mm) and the even smaller sheets are fixed with the power control of the heat generating member 12*b*.

The heat fixing apparatus described above was applied to a laser beam printer of a process speed of 16 sheets per minute (calculated by A4 size in longitudinal feeding) with the heat generating members 12*a*, 12*b* of a width of 4 mm, the heater substrate of a width of 12 mm, the heat generating member 12*a* of a length of 222 mm and the heat generating member 12*b* of a length of 154 mm, whereby the throughput of 16 sheets per minute could be obtained with sufficient fixing performance for the recording sheets with the width of B5 size or larger by controlling the power supply to the heat generating member 12*a* with a control circuit 21 in such a manner that the temperature of the heater at the position of the thermistor 14 is maintained at 190° C.

On the other hand, for the recording materials with the width of A5 size or smaller, a throughput of 10 sheets per minute could be obtained with sufficient fixing performance by controlling the power supply to the heat generating member 12*b* with a control circuit 22 in such a manner that the temperature of the heater at the position of the thermistor 14 is maintained at 190° C.

The throughput for the recording material of A5 size or smaller is made lower in order to prevent thermal damage to the heater supporting member, fixing film, pressure roller etc. even in the case of passing even narrower sheets such as envelopes.

In the above-described configuration, the heat from the heat generating member is transmitted to the nip surface through the ceramic substrate with thermal diffusion. Therefore, in the case where the heat generating member is divided into plural portions in width and a recording material is slightly narrower than the width of such heat generating member, the excessive temperature rise immediately outside the sheet passing area can be suppressed by such heat diffusion (thermal diffusion), whereby it is unnecessary to provide many heat generating members corresponding to the various sizes of the recording material. More specifically, it is rendered possible to obtain the same throughput for the recording material of the width of B5 size and that of A4 size by controlling the same heat generating member.

Also the heat diffusion mentioned above spreads the heat transmitting area in the nip surface (in the feeding direction of the recording material), thereby increasing the amount of heat supplied to the recording material per unit time. For this reason, there can be reduced the required width of the heat generating member for a higher process speed of the image forming apparatus, and the size of the heater can be minimized in the heating method of the present invention in which the plural heat generating members are independently controlled according to the width of the recording material.

In the following there will be explained, for the purpose of comparison, the conventional heater with the heat generating members opposed to the nip across a glass coating layer. The heater alone was replaced in the aforementioned laser beam printer of a throughput of 16 sheets per minute (longitudinal feeding of A4 sized sheet) and the fixing performance similar to the foregoing embodiment could be obtained with the heat generating members 12*a*, 12*b* of a width of 5 mm and the heat substrate of a width of 14 mm.

A throughput of 16 sheets per minute could be obtained with sufficient fixing performance for the recording materials of A4 or letter size by employing the heat generating member 12*a* of a length of 222 mm and the heat generating member 12*b* of a length of 154 mm by controlling the power supply to the heat generating member 12*a* with the control circuit 21 in such a manner that the heater temperature at the position of the thermistor 14 provided on the heat substrate becomes 190° C.

Figure 3:
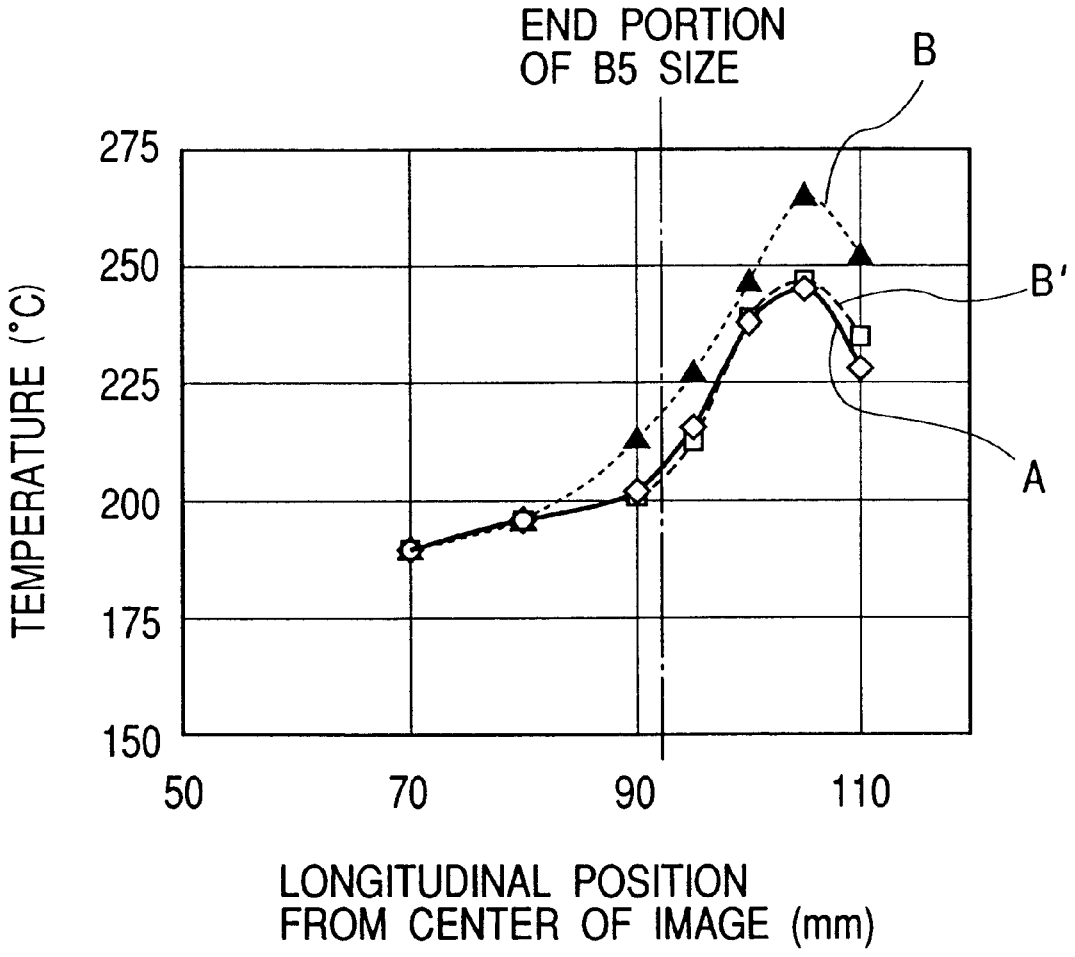
FIG. 3 is a chart showing the temperature as a function of the longitudinal position from the center of image.

However, for the recording material with the width of B5 size, the throughput had to be reduced to 12 sheets per minute because of the excessively large temperature rise in the sheet non-passing area. In the foregoing embodiment, in case of temperature control with the heat generating member 12*a* with continuous passing of the B5-sized recording materials, the temperature distribution assumes a form represented by a solid line A in FIG. 3, but, in a similar situation in the present comparative example, the temperature distribution assumes a form represented by a dotted line B in FIG. 3, and the throughput has to be lowered because of the excessively large temperature rise in the sheet non-passing area. A dotted line B' shows a case with a throughput of 12 sheets per minute, where the temperature rise in the sheet non-passing area is comparable to that in the foregoing embodiment.

On the other hand, for the recording materials with the width of A5 size or smaller, the throughput has to be reduced to 8 sheets, namely smaller than the foregoing embodiment by 2 sheets, in order to secure the sufficient fixing performance and to obtain the temperature rise in the sheet non-passing area comparable to that in the foregoing embodiment. The throughput for the A5 and smaller sizes is made lower for the aforementioned reason. As explained in the foregoing, the configuration having the heat generating members on the heater surface opposite to the nip surface allows suppression of the temperature rise in the sheet non-passing area resulting from a small difference in the width of the recording material (for example, the difference between A4 and B5 sizes) in case of the heater with the heat generating members divided into plural units, thereby allowing to reduce the number of heat generating members corresponding to the width of the recording materials.

Such configuration also allows reduction of the temperature rise in the sheet non-passing area for the recording material slightly narrower than the heat generating member, thereby allowing avoidance of the decrease in the throughput for such narrow recording materials. It is furthermore possible to reduce the width of the heat generating members in comparison with that in the conventional configuration, whereby the entire width of the substrate can be made smaller and such configuration can better accommodate the higher process speed of the image forming apparatus.

In the following there will be explained another embodiment of the present invention.

This embodiment is similar to the foregoing embodiment but the heater 12 employs an aluminum nitride (AlN) substrate 12*d*, which shows the following advantages in comparison with the conventional alumina substrate.

The AlN substrate has a thermal conductivity of 220 W/mK which is about 11 times of the thermal conductivity (20 W/mk) of an alumina substrate, and a heat capacity of about ⅔ for the same volume. Therefore, a faster temperature rise or a more uniform temperature distribution can be reached with the same input energy. Also the thermal shock resistance is larger by about 2 times, so that the damage to the substrate by rapid heating hardly occurs even at a higher temperature with a finer heat generating member.

As the AlN substrate has a thermal conductivity higher by about 2 digits than that of the glass coating layer, the thickness of the substrate can be selected to be about 10 times larger (0.5 to 0.8 mm, 0.65 mm in the present embodiment) than that of the glass coating. Despite of the limited thickness (about 30 to 60 $\mu$m) of the glass coating layer, it is rendered sufficiently possible, as in the present embodiment, to position the heat generating member 12*a*, glass coating layer 12*c* and the temperature sensor 14 on the upper surface of the AlN substrate of which rear surface constitutes the nip surface, wherein the AlN substrate ensures a quicker temperature rise in comparison with the alumina substrate and allows uniform heating over the entire substrate because of the higher thermal conductivity, thereby providing high fixing ability even at a high process speed.

Also the temperature distribution in the longitudinal direction tends to become more uniform whereby the excessive temperature rise in the sheet non-passing area, encountered in the case of continuous passing of the small-sized sheets, can also be relaxed. The configuration of the heater in the present embodiment will not be explained further as it is merely different in the material of the ceramic substrate from that in the foregoing embodiment.

The heat fixing apparatus described above was applied to a laser beam printer of a process speed of 16 sheets per minute (calculated by A4 size in longitudinal feeding) with the heat generating members 12*a*, 12*b* of a width of 3 mm, the heater substrate of a width of 10 mm, the heat generating member 12*a* of a length of 222 mm and the heat generating member 12*b* of a length of 154 mm, whereby the throughput of 16 sheets per minute could be obtained with sufficient fixing performance for the recording sheets with the width of B5 size or larger by controlling the power supply to the heat generating member 12*a* with the control circuit 21 in such a manner that the temperature of the heater at the position of the thermistor 14 is maintained at 190° C.

On the other hand, for the recording materials with the width of A5 or smaller, a throughput of 14 sheets per minute could be obtained with sufficient fixing performance by controlling the power supply to the heat generating member 12*b* with the control circuit 22 in such a manner that the temperature of the heater at the position of the thermistor 14 is maintained at 190° C. The throughput for the recording material of A5 size or smaller is made lower in order to prevent thermal damage to the heater supporting member, fixing film, pressure roller etc. even in the case of passing sheets such as envelopes narrower than A5 size.

The above-described configuration employing the AlN substrate of high thermal conductivity for the heater substrate and having the heat generating members on the surface opposite to the nip allows achievement the effects of the foregoing embodiment in a more effective manner and reduction of the width of the ceramic substrate, thereby being particularly effective for a higher process speed of the image forming apparatus.

Figure 4:
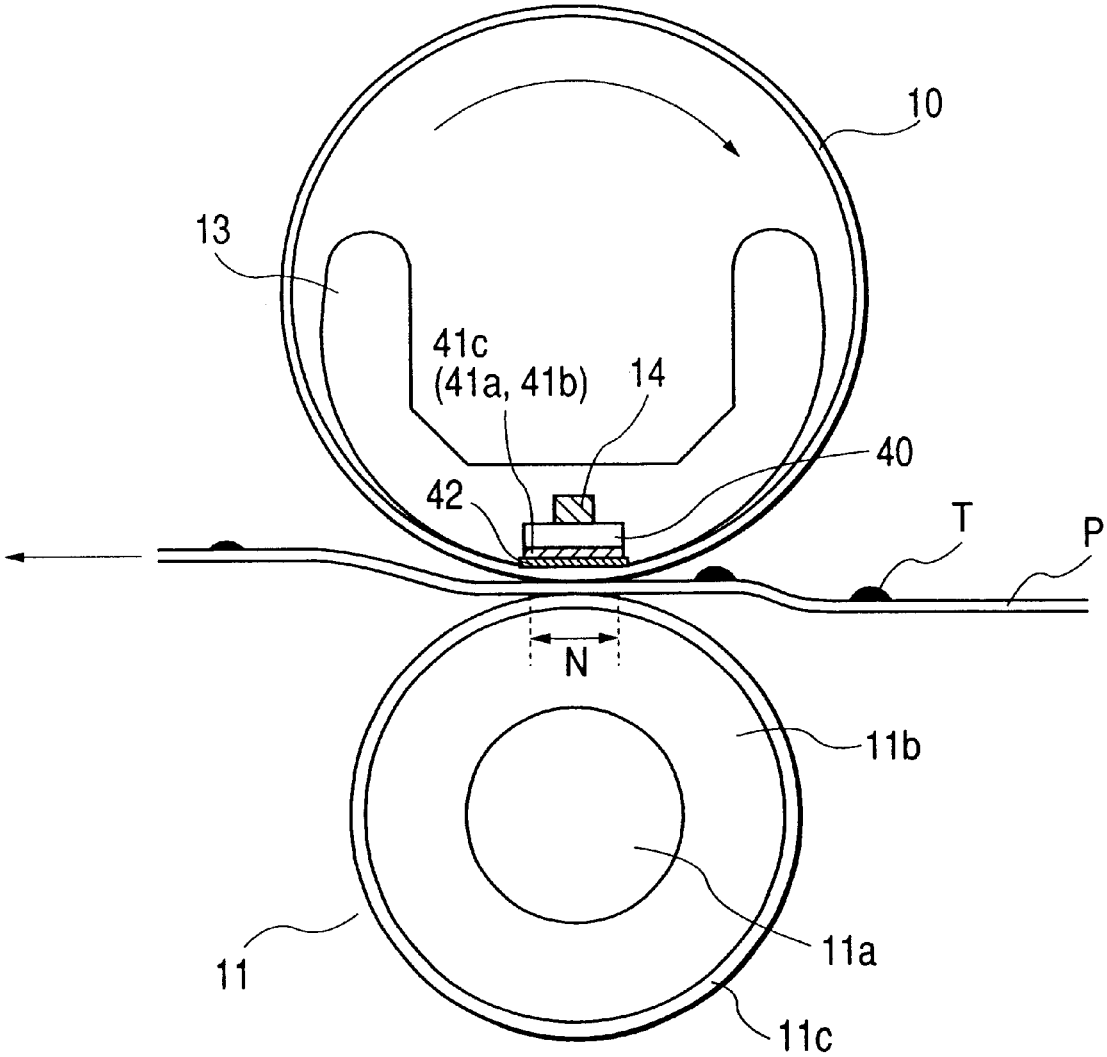
FIG. 4 is a view showing another embodiment of the image heating apparatus.

FIG. 4 is a schematic cross-sectional view of a heat fixing apparatus constituting still another embodiment. In the present embodiment, heat generating members 41*a*, 41*b* are provided on the nip-side surface of the heater substrate as in the conventional configuration, and a glass coating layer 41*c* is provided thereon. Contact with the film 10 is made across a high heat-conductive member 42 composed for example of aluminum, copper or iron and provided thereon, and such embodiment will be explained in the following.

Figure 5:
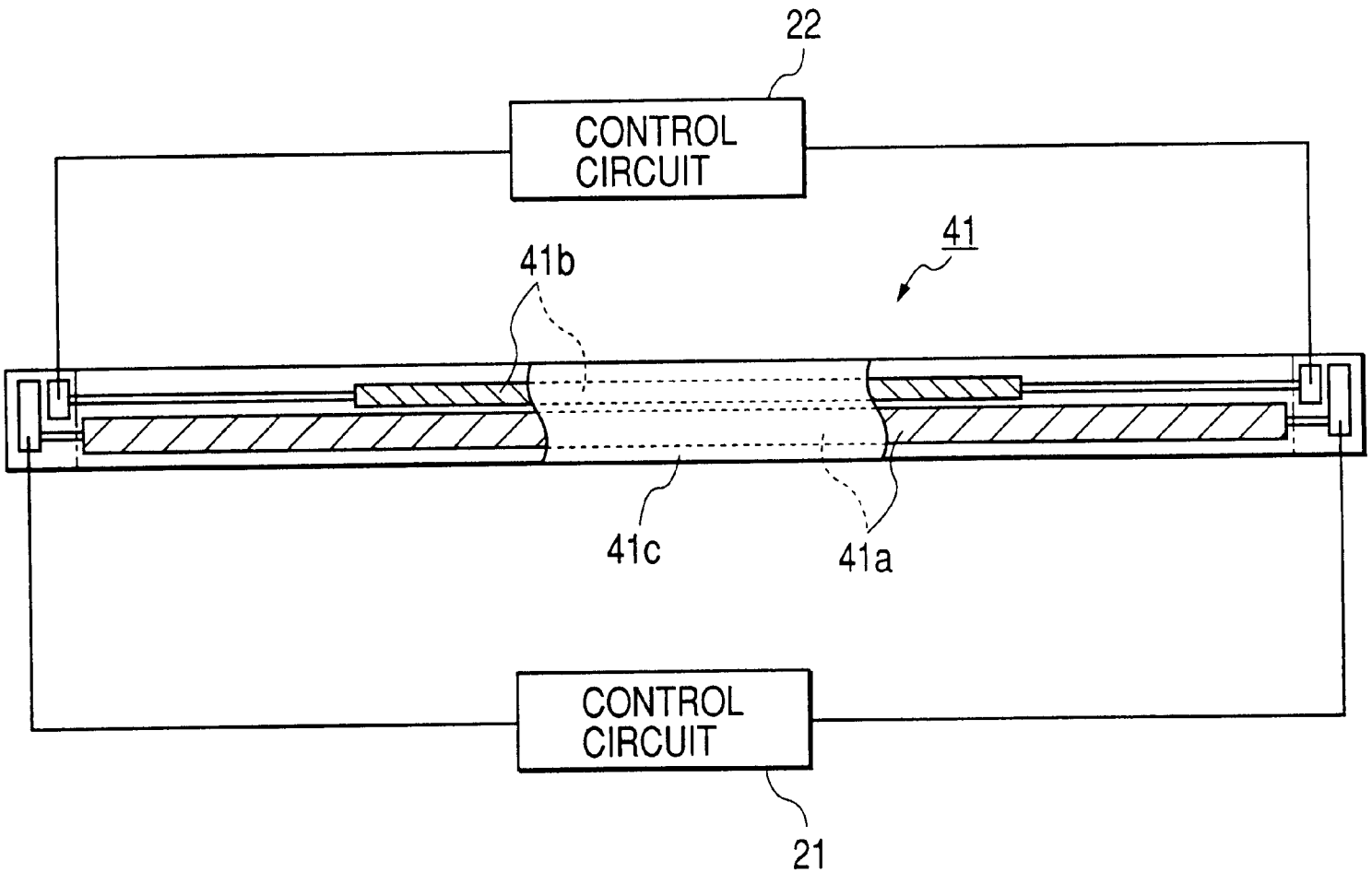
FIG. 5 is a view showing the arrangement of heat generating members on the heater.

The fixing film 10, the pressure roller 11 and the film guide 13 supporting a heater 40 will not be explained further as they are similar to those in the foregoing embodiment. The heater 40 is obtained by forming the heat generating members 40*a*, 40*b* by printing and sintering of Ag/Pd paste, with a pattern shown in FIG. 5, on an $Al_2O_3$ or AlN substrate and forming the glass coating layer with a thickness of 50 to 60 $\mu$m.

On the other hand, a chip-shaped thermistor 14 is adhered to a face 41*d* of the substrate opposite to the face bearing the heat generating members 41*a*, 41*b*, on an electrode pattern formed in advance by thick film printing in an area where the heat generating members 41*a*, 41*b* are both present (within the passing area of the smallest-sized recording material), for monitoring the temperature of the heater substrate, thereby controlling the power supply to either heat generating member according to the size information of the recording material.

Figure 6:
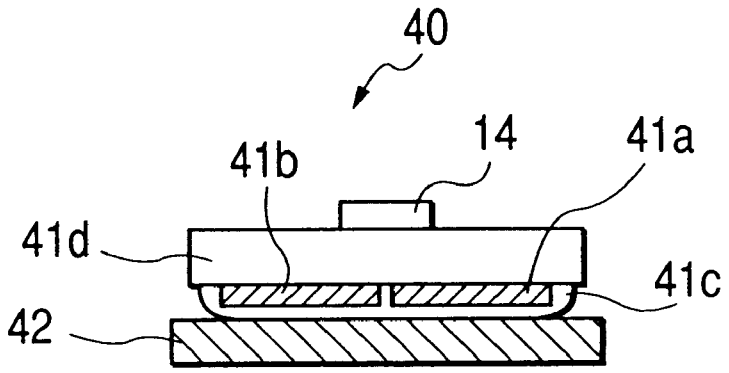
FIGS. 6 and 7 are cross-sectional views of the heater.

In the present embodiment, a sensor (not shown) is provided slightly outside the width of the heat generating member 41*b* in the conveying path, and the heat generating member to be activated is selected according to the signal from such sensor. Between the nip surface and the heater 40 there is provided, as shown in FIG. 6, a metal plate 42 of a high thermal conductivity, which is wider and is so provided as to cover the entire sheet passing area in the longitudinal direction.

In the present embodiment, the metal plate 42 is composed of an aluminum plate of a thickness of 1 mm, which is provided, on the surface coming in contact with the fixing film 10, with a hard plating such as KN plating or chromium plating or a thin glass coating with a thickness not exceeding 15 $\mu$m, in order to prevent abrasion resulting from sliding contact with the fixing film 10.

Also in the above-described configuration, as in the foregoing embodiment, the heat from the heat generating members 41*a*, 41*b* is transmitted to the nip surface through the high heat-conductive member (metal plate 42 in the present embodiment) with diffusion of heat. Consequently, in the case of dividing the heat generating member into plural portions in the width and passing the recording material slightly narrower than the width of such heat generating member, such thermal diffusion suppresses the excessive temperature rise immediately outside the sheet passing area, whereby there can be reduced the number of the heat generating members required corresponding to the recording materials of various sizes. More specifically, as in the foregoing embodiments, the same throughput can be obtained for the recording material of the width of B5 size and that of the width of A4 size by controlling the power supply to the same heat generating member.

Also the heat diffusion mentioned above spreads the heat transmitting area in the nip surface (in the feeding direction of the recording material), thereby increasing the quantity of heat supplied to the recording material per unit time. For this reason, there can be reduced the required width of the heat generating member for a higher process speed of the image forming apparatus, and the size of the heater can be minimized in the heating method of the present invention in which the plural heat generating members are independently controlled according to the width of the recording material.

In the following there will be explained the operations and effects of the present embodiment.

The maximum width of the recording material is selected as the letter size (216 mm), and the slightly narrower recording sheets of A4 size (210 mm) and B5 size (182 mm) are fixed with the power control of the heat generating member 41*a*. On the other hand, the sheet of A5 size (148 mm) and the even smaller sheets are fixed with the power control of the heat generating member 41*b*.

The heat fixing apparatus described above was applied to a laser beam printer of a process speed of 16 sheets per minute (calculated by A4 size in longitudinal feeding) with the heat generating members 41*a*, 41*b* of a width of 4 mm, the heater substrate of a width of 12 mm, the heat generating member 41*a* of a length of 222 mm and the heat generating member 41*b* of a length of 154 mm, whereby the throughput of 16 sheets per minute could be obtained with sufficient fixing performance for the recording sheets with the width of B5 size or larger by controlling the power supply to the heat generating member 41*a* with the control circuit 21 in such a manner that the temperature of the heater at the position of the thermistor 14 is maintained at 190° C.

On the other hand, for the recording materials with the width of A5 size or smaller, a throughput of 11 sheets per minute could be obtained with sufficient fixing performance by controlling the power supply to the heat generating member 41*b* with the control circuit 22 in such a manner that the temperature of the heater at the position of the thermistor 14 is maintained at 190° C.

The above-described configuration having the member 42 of high thermal conductivity between the heater 40 and the fixing film 10 not only provides the effects similar to those in the foregoing embodiments, but also allows positioning of the thermistor 14, constituting the temperature sensor, on a face of the heater substrate opposite to the face bearing the heat generating members 41*a*, 41*b* thereby enabling adherence of the thermistor directly to the substrate and forming the electrodes therefore directly on the substrate, thus attaining superior mass producibility of the heater 40.

The presence of the metal plate 42 on the side of the nip surface of the heater 40 may retard the heating of the heater, but, according to the investigation of the present inventors, the heat from the heater 40 in the heat fixing apparatus of the film heating type is mostly absorbed by the pressure roller 11 and the recording material P while the heat capacity (quantity) of the heater 40 is almost negligible. Therefore, even in the presence of the metal plate 42 on the heating surface as in the present embodiment, it is experimentally confirmed that such metal plate scarcely hinders the temperature rise of the heat fixing apparatus if the thickness of the metal plate does not exceed 2.5 mm. Also for achieving uniform temperature distribution on the heater substrate, the thickness of the metal plate 42 preferably-does not exceed 0.5 mm.

Figure 7:
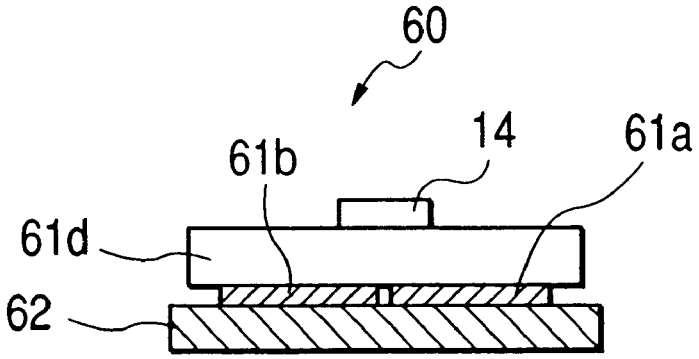

FIG. 7 is a schematic cross-sectional view of a heater constituting still another embodiment. This embodiment is featured by providing heat generating members 61*a*, 61*b* on the nip surface of a heater substrate 61*d* and forming directly thereon a ceramic member 62 of high thermal conductivity such as AlN or SiC (with a thickness preferably within a range of 0.3 to 1.2 mm) for contact with the fixing film. This embodiment will be explained in the following.

The fixing film 10, pressure roller 11, film guide 13 for supporting the heater 60 will not be explained further as they are similar to those in the foregoing embodiments. The heater 60 is obtained by forming the heat generating members 61*a*, 61*b* by thick film printing and sintering of Ag/Pd paste with the pattern shown in FIG. 5 on an $Al_2O_3$ or AlN substrate.

On the other hand, a chip-shaped thermistor 14 is adhered to a face of the substrate opposite to the face bearing the heat generating members 61*a*, 61*b*, on an electrode pattern formed in advance by thick film printing in an area where the heat generating members 61*a*, 61*b* are both present (within the passing area of the smallest-sized recording material), for monitoring the temperature of the heater substrate, thereby controlling the power supply to either heat generating member according to the size information of the recording material.

In the present embodiment, a sensor is provided slightly outside the width of the heat generating member 61*b* in the conveying path, and the heat generating member to be activated is selected according to the signal from such sensor. Between the nip surface and the heater 60 there is provided, as shown in FIG. 7, a ceramic plate 62 of a high thermal conductivity, which is wider and is so provided as to cover the entire sheet passing area in the longitudinal direction.

In the present embodiment, the ceramic plate 62 is composed of an AlN plate of a thickness of 0.5 mm, which is subjected, on the surface coming in contact with the fixing film 10, to lapping or is provided with a thin glass coating with a thickness not exceeding 15 $\mu$m (not shown), in order to prevent abrasion resulting from sliding contact with the fixing film 10.

Also in the above-described configuration, as in the foregoing embodiment, the heat from the heat generating members 61*a*, 61*b* is transmitted to the nip surface through the member of high thermal conductivity (ceramic plate 62 in the present embodiment) with thermal diffusion. Consequently, in case of dividing the heat generating member into plural portions in the width and passing the recording material slightly narrower than the width of such heat generating member, such heat diffusion suppresses the excessive temperature rise immediately outside the sheet passing area, whereby there can be reduced the number of the heat generating members required corresponding to the recording materials of various sizes. Also there can be attained a very high thermal efficiency, because the heat is transmitted directly from the heat generating member to the nip surface without the glass coating layer.

More specifically, as in the foregoing embodiments, the same throughput can be obtained for the recording material of the width of B5 size and that of the width of A4 size by controlling the power supply to the same heat generating member. Also the heat diffusion mentioned above spreads the heat transmitting area in the nip surface (in the feeding direction of the recording material), thereby increasing the quantity of heat supplied to the recording material per unit time. For this reason, there can be reduced the required width of the heat generating member for a higher process speed of the image forming apparatus, and the heating method of the present invention in which the plural heat generating members are independently controlled according to the width of the recording material is optimum for minimizing the size of the heater and is considerably effective for a process speed of 20 sheets per minute or higher in the image forming apparatus.

In the following there will be explained the operations and effects of the present embodiment.

The maximum width of the recording material is selected as the letter size (216 mm), and the sightly narrower recording sheets of A4 size (210 mm) and B5 size (182 mm) are fixed with the power control of the heat generating member 61*a*. On the other hand, the sheet of A5 size (148 mm) and the even smaller sheets are fixed with the power control of the heat generating member 61*b*.

The heat fixing apparatus described above was applied to a laser beam printer of a process speed of 16 sheets per minute (A4 size in longitudinal feeding) with the heat generating members 61*a*, 61*b* of a width of 4 mm, the heater substrate of a width of 12 mm, the heat generating member 61*a* of a length of 222 mm and the heat generating member 61*b* of a length of 154 mm, whereby the throughput of 16 sheets per minute could be obtained with sufficient fixing performance for the recording sheets with the width of B5 size or larger by controlling the power supply to the heat generating member 61*a* with the control circuit 21 in such a manner that the temperature of the heater at the position of the thermistor 14 is maintained at 180° C.

On the other hand, for the recording materials with the width of A5 size or smaller, a throughput of 14 sheets per minute could be obtained with sufficient fixing performance by controlling the power supply to the heat generating member 61*b* with the control circuit 22 in such a manner that the temperature of the heater at the position of the thermistor 14 is maintained at 180° C. The throughput for the recording material of A5 size or smaller is made lower for the same reason as that in the foregoing embodiments.

The above-described configuration having the member 62 of high thermal conductivity between the heater 40 and the fixing film 10 provides the effects similar to those in the foregoing embodiments. Also the presence of the insulating ceramic plate 62 of high thermal conductivity on the side of the nip surface of the heater realizes direct heating of the fixing film 10 by the heat generating members 61*a*, 61*b* of the heater 60, whereby the heat is efficiently transmitted to the nip surface to attain a very high thermal efficiency suitable for a high process speed of the image forming apparatus.

Furthermore, the effects of the present invention can naturally be effectively attained by applying the embodiments shown in FIGS. 6 and 7 to the configuration shown in FIG. 1 where the heat generating members are provided on a surface opposite to the nip surface.

Figure 8:
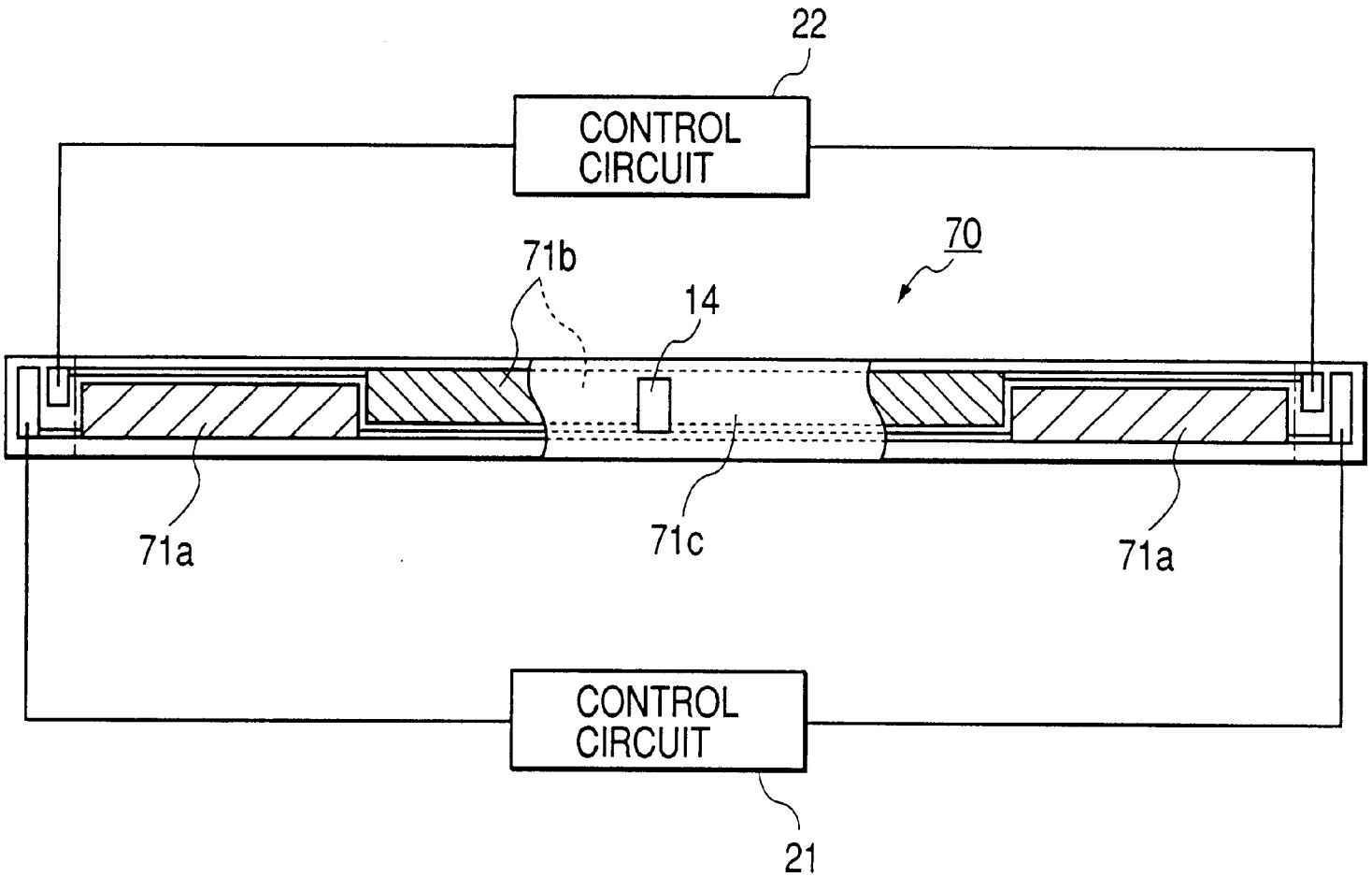
FIG. 8 is a view showing the arrangement of heat generating members on the heater.

FIG. 8 is a schematic view of a heater constituting still another embodiment, which has the feature of providing heat generating members 71*a*, 71*b* of a heater 70 on a surface opposite to the nip surface of the heater substrate and forming the heat generating members in such a pattern as to attain a substantially uniform temperature distribution in a direction perpendicular to the feeding direction of the recording material by simultaneously activating plural heat generating members. This embodiment will be explained in the following.

The fixing film 10, pressure roller 11, film guide 13 for supporting the heater 70 will not be explained further as they are similar to those in the foregoing embodiments. The heater 70 is obtained by forming the heat generating members 71*a*, 71*b* by thick film printing and sintering of Ag/Pd paste with the pattern shown in FIG. 8 on an $Al_2O_3$ or AlN substrate, then forming a glass coating layer 71*c* thereon and positioning a thermistor 14 thereon, which monitors the heater temperature, thereby controlling the power supply to either or both heat generating members according to the size information of the recording material.

In the present embodiment, a sensor (not shown) is provided slightly outside the width of the heat generating member 71*b* in the conveying path, and the heat generating member to be activated is selected according to the signal from such sensor.

In the present embodiment, based on the illustrated pattern of the heat generating members, the recording material P wider than the heat generating member 71*b* is fixed under temperature control by simultaneous activation of both heat generating members 71*a*, 71*b*. Therefore, even in case the width of each heat generating member increases for a higher process speed of the image forming apparatus, it is not required to arrange two heat generating members of a large width in parallel manner, so that the width of the heater substrate can be made approximately equal to the conventional configuration for power supply control with a single heat generating member.

On the other hand, in case such heat generating members are applied to the conventional heater (having the heat generating members at the side of the nip surface), there is required a gap for maintaining an insulation (0.3 to 0.8 mm) between the heat generating members 71*a* and 71*b*, and the heater temperature becomes locally lower in such gap because of the absence of the heat generating member, resulting in poor image fixing.

However, in case the heat generating members are provided on the surface of the heater substrate opposite to the nip surface as in the present embodiment, the heat transmitted to the nip surface causes diffusion within the heater substrate whereby the local temperature drop is scarcely noticeable. Such effect becomes conspicuous particularly when the heater substrate is composed of AlN of high thermal conductivity, and a similar effect can be obtained when a member 42, 62 of high thermal conductivity is provided in contact with the heat generating member as in the embodiments shown in FIGS. 6 and 7.

Also in the above-described configuration, as in the foregoing embodiment, the heat from the heat generating members 71*a*, 71*b* is transmitted to the nip surface through the heater substrate (ceramic plate in the present embodiment) with thermal diffusion. Consequently, in case of dividing the heat generating member into plural portions in the width and passing the recording material slightly narrower than the width of such heat generating member, such heat diffusion suppresses the excessive temperature rise immediately outside the sheet passing area, whereby there can be reduced the number of the heat generating members required corresponding to the recording materials of various sizes. Thus the heating method in which the plural heat generating members are independently controlled according to the width of the recording material is optimum for minimizing the size of the heater, and is considerably effective for the image forming apparatus with a process speed of 25 sheets per minute or higher.

In the following there will be explained the operations and effects of the present embodiment.

The maximum width of the recording material is selected as the letter size (216 mm), and the slightly narrower recording sheets of A4 size (210 mm) and B5 size (182 mm) are fixed with the power control of the heat generating members 71*a* and 71*b*. On the other hand, the sheet of A5 size (148 mm) and the even smaller sheets are fixed with the power control of the heat generating member 71*b*.

The heat fixing apparatus described above was applied to a laser beam printer of a process speed of 24 sheets per minute (calculated by A4 size in longitudinal feeding) with the heat generating members 71*a*, 71*b* of a width of 6 mm, the heater substrate of a width of 9 mm, the heat generating member 71*a* of a length of 222 mm and the heat generating member 71*b* of a length of 154 mm, whereby the throughput of 24 sheets per minute could be obtained with sufficient fixing performance for the recording sheets with the width of B5 size or larger by controlling the power supply to the heat generating members 71*a*, 71*b* with the control circuits 21, 22 in such a manner that the temperature of the heater at the position of the thermistor 14 is maintained at 190° C.

On the other hand, for the recording materials with the width of A5 size or smaller, a throughput of 16 sheets per minute could be obtained with sufficient fixing performance by controlling the power supply to the heat generating member 71*b* with the control circuit 22 in such a manner that the temperature of the heater at the position of the thermistor 14 is maintained at 190° C. The throughput for the recording material of A5 size or smaller is made lower for the same reason as that in the foregoing embodiments.

In the above-described configuration having plural heat generating members to be simultaneously activated on the surface of the heater substrate opposite to the nip surface thereof as in the foregoing embodiment shown in FIG. 1 and arranging such plural heat generating members in such a manner as to obtain a substantially uniform temperature distribution in the direction perpendicular to the feeding direction of the recording material by simultaneous activation of the plural heat generating members at the same time it is rendered possible to minimize the increase in the width of the heater substrate, thus providing a heat fixing apparatus suitable for achieving the higher process speed in the image forming apparatus.

As explained in the foregoing, the heat generating member for heating the small-sized recording material is generally shorter than that for heating the large-sized recording material, thus having a smaller electrical resistance and showing a larger current under a voltage application the same as that for the heat generating member for the large-sized recording material, thereby causing a flickering phenomenon in the peripheral equipment.

For avoiding this drawback, there is conceived a method of decreasing the voltage applied to the heat generating member for the small-sized recording material, but such method is not preferable because of the complication in the power supply circuit.

Figure 16:
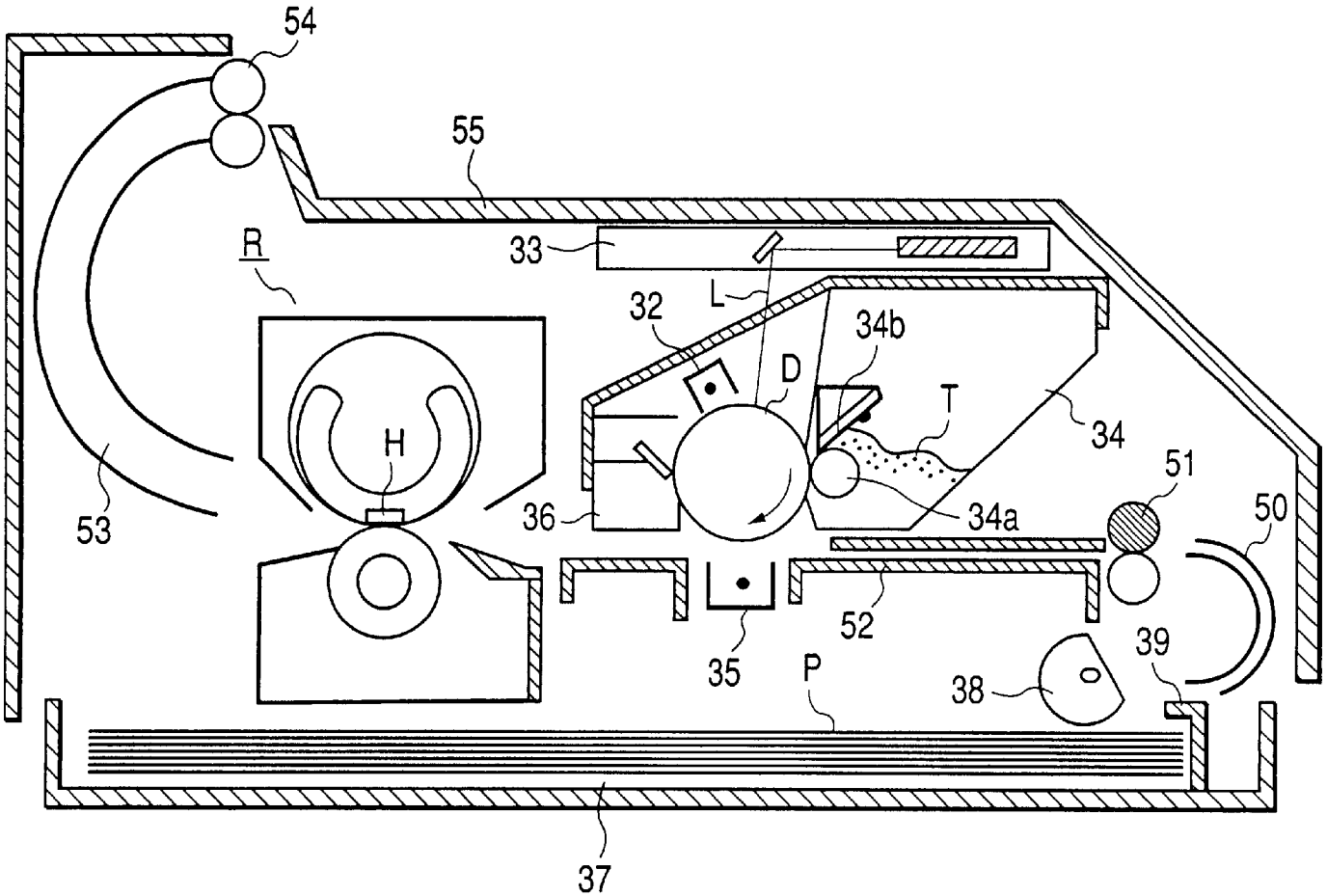
FIG. 16 is a view showing a heater constituting a comparative example to the present invention.

In the following there will be explained an embodiment of the present invention, capable of preventing such flickering phenomenon without complicating the power supply. FIG. 16 schematically shows the image forming apparatus in which the present invention is applicable.

The image forming apparatus of the present embodiment is a laser beam printer utilizing an electrophotographic process of transfer type.

An electrophotographic photosensitive member D of rotary drum shape (hereinafter represented as photosensitive drum) serving as an image bearing member is rotated clockwise, as indicated by an arrow, at a predetermined peripheral speed (process speed).

In the course of rotation, the photosensitive drum D is subjected to uniform charging at predetermined polarity and potential (dark portion potential) $V_D$ by a primary charger 32 and scanning exposure L by a laser beam coming from a laser scanner 33 and corresponding to the desired image information, whereby an electrostatic latent image corresponding thereto is formed on the photosensitive drum D.

In response to an image information signal (time-sequential digital pixel signal) transmitted from an external device such as an unrepresented host computer, the laser scanner 33 outputs an intensity modulated laser beam for scanning exposing L (raster scanning) the uniformly charged surface of the photosensitive drum D. The intensity and spot diameter of the laser beam are appropriately selected according to the resolution and the desired image density of the printer.

On the uniformly charged surface of the photosensitive drum D, a portion exposed to the laser beam assumes a light portion potential $V_L$ by potential attenuation while a non-exposed portion remains at the dark portion potential $V_D$ charged by the primary charger 32 to obtain an electrostatic latent image.

The electrostatic latent image formed on the photosensitive drum D is developed in continuous manner by a developing unit 34. Toner T in the developing unit 34 is subjected to the control of the toner layer thickness and the triboelectricity by a developing sleeve 34*a* serving as a toner supplying rotary member and a developing blade 34*b*, thereby forming a uniform toner layer on the developing sleeve 34*a*. The developing blade 34*b* is generally composed of a metal or a resinous material, and a resin blade is maintained in contact with the developing sleeve 34*a* with an appropriate contact pressure. The toner layer formed on the developing sleeve 34*a* is brought, by the rotation of the developing sleeve 34*a*, to a position opposed to the photosensitive drum D, where the portion of the light portion potential $V_L$ is selectively visualized (reversal development) by an electric field formed by a voltage $V_{dc}$ applied to the developing sleeve 34*a* and the surface potential of the photosensitive drum D.

The toner image formed on the photosensitive drum D is transferred, in a transfer position where the photosensitive drum D is opposed to a transfer unit 35, in continuous manner onto a recording sheet (transfer or recording material) P supplied to such transfer position at a predetermined timing of control. The transfer unit 35 may be composed of a corona charger as illustrated or a transfer roller composed of a conductive elastic rotary member which receives a current from a power source and conveys the recording material while giving a transfer charge thereto.

A sheet cassette 37 is mounted in the lower part of the printer and stores the recording materials P in a stacked state. A recording material P in the sheet cassette 37 is separated by a feeding roller 38 and a separating finger 39, and is conveyed to the transfer position at a predetermined timing through a sheet path 50, registration rollers 51 and a sheet path 52. The recording material P receiving the transfer of the toner image at the transfer position is separated in continuous manner from the photosensitive drum D, then is introduced into a fixing unit R constituting an image heating apparatus and is subjected to the fixing of the toner image (formation of permanent image by heat and pressure). The recording material is then discharged to a tray 55 through a sheet path 53 and discharge rollers 54.

The photosensitive drum D after the separation of the recording material is cleaned by a cleaning device 36 for removing the remaining substance such as remaining toner, and is subjected again to the image formation process.

In the following there will be explained a specific example of the fixing unit R utilizing a film driven by a pressure roller equipped with a heating member H.

Figure 15A:
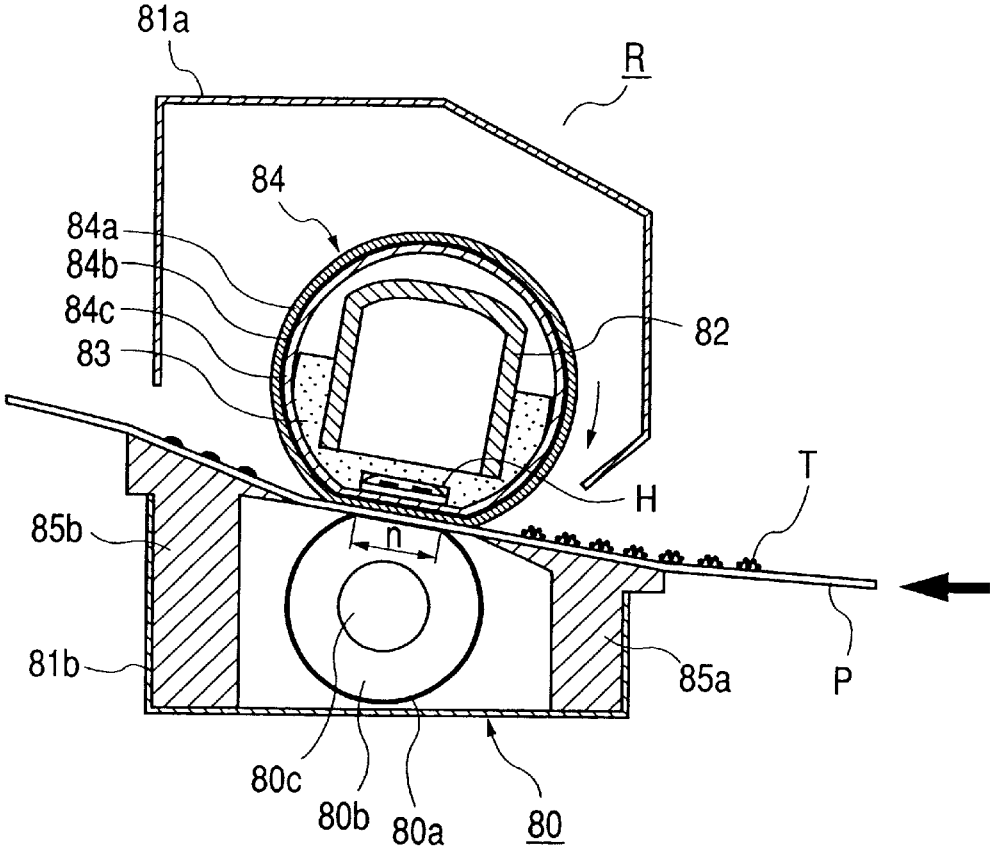
FIGS. 15A and 15B are views showing an image heating apparatus constituting an embodiment of the present invention.
Figure 15B:
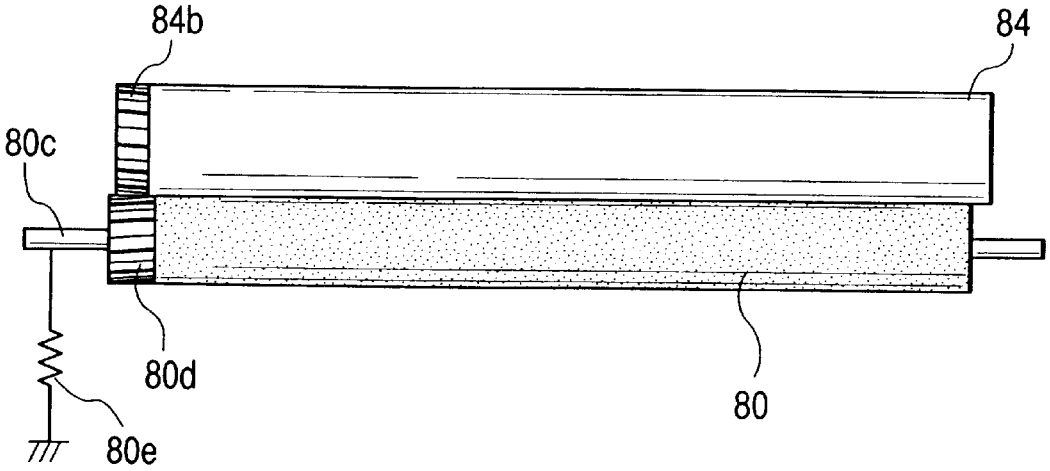

FIGS. 15A and 15B are respectively a schematic cross-sectional view and a schematic elevation view, seen from the front (sheet feeding) side, of the fixing unit R. The toner image T formed on the recording material P is conveyed along a fixing entrance guide 85*a* to a nip portion n between a pressure roller 80, having a mold releasing layer 80*a* and a heat-resistant rubber layer 80*b* and supported at a metal core 80*c* by a lower frame 81*b* of the fixing unit, and a cylindrical fixing film 84 which is conveyed in rotation along a heater holder 83, serving as a film guide member, by the rotation of the pressure roller 80 under a frictional force caused by a total pressure of about 4 to 15 kfg exerted by unrepresented pressurizing means of an upper frame 81*a* of the fixing unit onto a metal stay 82, and is fixed under heat and pressure applied by the heater H across the fixing film 84. In the present embodiment, the heater H is so constructed that the heating surface (for giving thermal energy to the recording material P) is formed on an insulating substrate 91 opposite to a surface thereof provided with heat generating resistors h1, h2 and is so supported that such heating surface faces the recording material P (side of nip n).

The heater is controlled at a predetermined temperature by the control in phase and frequency of the voltage supplied to the heat generating resistors.

In order to decrease the heat capacity for improving the quick starting property, the fixing film 84 is composed of a heat-resistant, mold releasing and durable film with a thickness not exceeding 100 $\mu$m, preferably within a range of 40 to 20 $\mu$m, such as a single-layered film composed of PTFE, PFA or PPS or a film of composite structure, as illustrated, having a base film 84*c* such as of polyimide, polyamidimide, PEEK or PES, a conductive primer layer 84*b* and a coated or tube-formed releasing layer 84*a* of a fluorinated resin such as PTFE, PFA or FEP. When the fixing film has such three-layered structure, the conductive primer layer is exposed at an end of the fixing film as shown in FIG. 15B while a conductive rubber ring 80*d* is fitted, at an end of the pressure roller corresponding to the exposed primer layer, on the metal core 80*c* of the pressure roller and is contacted with the exposed primer layer for grounding the same through a resistor 80*e*, thereby stabilizing the potential of the fixing film 84 and suppressing the detrimental electrostatic influence on the toner image borne on the recording material.

Figure 10A:
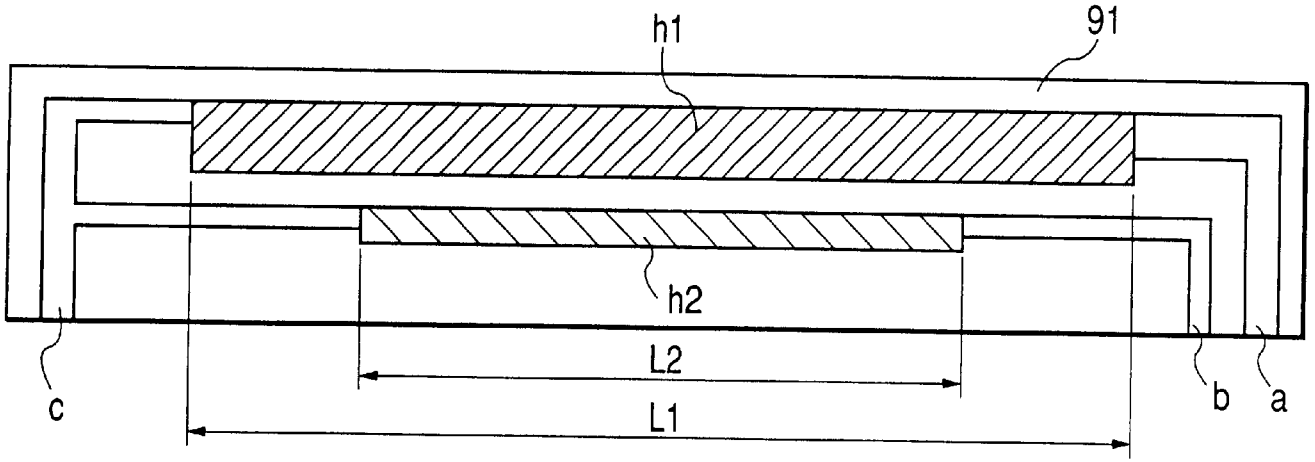
FIGS. 10A and 10B are views showing the arrangement of heat generating members on the heater.
Figure 10B:
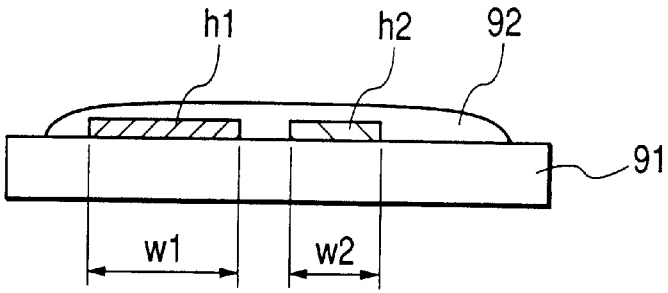

FIGS. 10A and 10B illustrate the heater of the fixing apparatus embodying the present invention.

FIG. 10A is a view showing the pattern of the heat generating members in the longitudinal direction of the heater, and FIG. 10B is a magnified lateral cross-sectional view thereof.

In this embodiment, the heat generating members (resistance heat generating member) are formed, on an aluminum nitride substrate 91, by coating Ag/Pd paste in two patterns h1 (for large size) and h2 (for small size). Glass 92 is coated on the heat generating members h1, h2 for insulating the same from electrical components such as a thermistor and from the film surface.

The heat generating members h1, h2 generate heat by means of a power supply through electrodes a, b, c, and are selected according to the size of the recording material to be passed. When the recording material of a first (large) size is passed, there is activated the longer (first) heat generating member h1 having a length L1 along the longitudinal direction of the substrate, but, when the recording material of a second (small) size, having a longitudinal length not exceeding L2, is passed, there is activated the shorter (second) heat generating member h2.

Width (width in a direction perpendicular to the longitudinal direction of the substrate) w1 of the heat generating member h1 and width w2 of the heat generating member h2 satisfy a relation:

$$w2<w1.$$

(w2: width of heat generating member for small size, w1: width of heat generating member for large size)

Thus, in the present embodiment, the resistance of the heat generating member for small size can be increased by reducing the width thereof whereby it is rendered possible to prevent a large current or a large power consumption in the heat generating member for the small size even under a voltage application the same as that for the heat generating member for the large size, thereby preventing the flickering phenomenon.

In the case of fixing the recording materials of different sizes, it is desirable to vary the heat generating width according to the size, since the required heat quantity is dependent on the sheet size. For fixing a sheet of a larger size, there is required a larger quantity of heat in comparison with the case of fixing a sheet of a smaller size.

In the present embodiment, since the width w1 of the heat generating member for the large size is selected to be larger than the width w2 of the heat generating member for the small size, the heater temperature in the nip width can be restored quicker even when a larger amount of heat is absorbed by the recording material. Such increased width w1 of the heat generating member for the large size is advantageous for fixing performance, as the heat can be generated in a wider area within the nip formed by the heater and the pressure roller.

Figure 11:
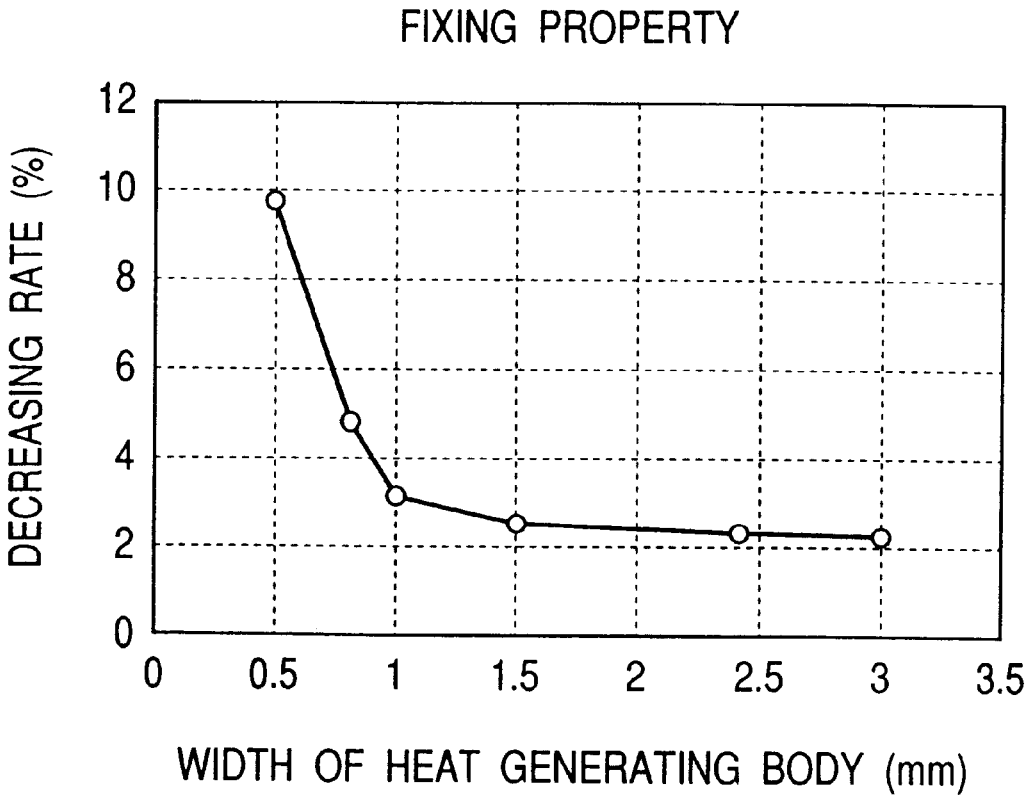
FIG. 11 is a chart showing the fixing property as a function of the width of the heat generating member.

FIG. 11 shows the result of evaluation of the fixing performance with different widths w1 of the heat generating member h1.

The fixing performance was evaluated with heaters having different widths w1 within a range of 0.5 to 3.0 mm but having the same longitudinal length L1 of 222 mm, the same center position of the width on the substrate, and the same entire resistance. A recording material of letter size (longitudinal size of 216 mm), composed of Plover Bond 90 g/m$^2$ disadvantageous for fixing because of surface irregularities, was passed for image fixation with the heat generating member for the large size at a heater temperature of 200° C. An evaluation pattern was printed with a printer of a printing speed of 16 sheet/min with a sheet conveying speed of 94.2 mm/sec, and the fixing performance was evaluated by sliding frictionally the image pattern and measuring the loss of image density before and after the frictional sliding.

In this evaluation, the samples with different widths w1 of the heat generating member had the same entire resistance to obtain a constant amount of heat. The results indicate that a larger width w1 of the heat generating member is favorable for the fixing performance. For satisfactory fixing, there is required a density decrease rate not exceeding about 4%, and the results shown in FIG. 11 indicate that the width w1 of the heat generating member is preferably equal to 1.0 mm or larger. This is presumably because the heat generating member with an excessively small width is unable to heat the substrate 91 in the entire width thereof but causes a temperature rise only in the vicinity of the heat generating member within the width of the heating nip formed with the pressure roller, thus being unable to execute heat fixing of the toner in the entire nip.

In the heat generating member h2 for the small size, the fixing performance comparable to that with the heat generating member h1 for the large size can be attained with a smaller width w2, because a smaller amount of heat is required. For satisfactory fixing, there is preferred a width w2 of 1 mm or larger.

Thus, satisfactory fixing performance can be obtained with a same power for the heat generating member h1 for the large size and the heat generating member h2 for the small size, for example with:

heat generating member for large size:
length L1=200 mm,
width=3 mm, heat generating member for small size:
length L1=100 mm,
width=1.5 mm.

In particular, the heat generating member h1 for the large size could generate heat within a wide area within the nip formed by the heater and the pressure roller, thus showing satisfactory fixing performance. Also the heat generating member h2 for the small size shows satisfactory fixing performance for the envelopes, despite the smaller width.

As explained in the foregoing, in the present embodiment, the width w1 of the heat generating member h1 is made larger to obtain more satisfactory fixing performance, and, in the heat generating member h2 for the small size, prone to have a lower resistance between the electrodes b and c, the width w2 is made smaller to obtain a power consumption the same as that in the heat generating member h1, thereby preventing the flickering phenomenon. Such a well balanced configuration of the heat generating member h1 for the large size and that of h2 for the small size allows simplification of the power control circuit and prevention of the flickering phenomenon. Also the smaller width w2 of the heat generating member h2 for the small size facilitates arrangement of the heat generating members within the heating nip.

Also such improved fixing performance allows for a higher process speed of the image forming apparatus.

Furthermore, also in the present embodiment the heat generating members are positioned on a surface of the substrate opposite to the nip surface and there can be attained the effect similar to that of the embodiment shown in FIG. 1.

Figure 12A:
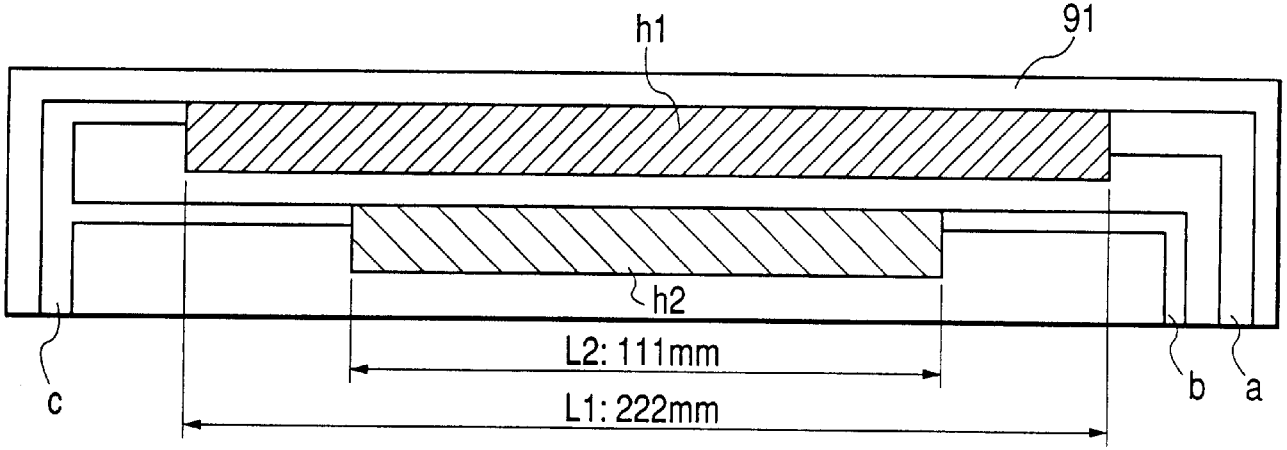
FIGS. 12A and 12B are views showing the arrangement of heat generating members on the heater.
Figure 12B:
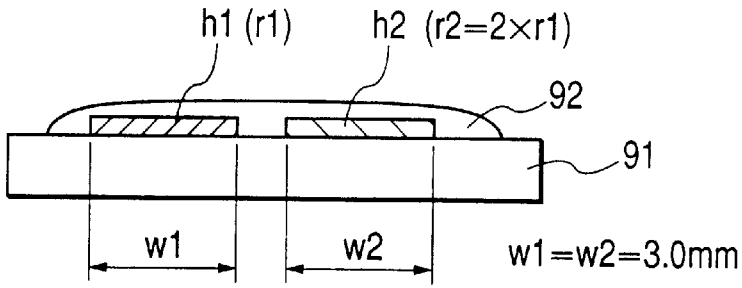

In the following there will be explained another embodiment of the present invention with reference to FIGS. 12A and 12B.

In this embodiment the heat generating member h1 for the large size and the heat generating member h2 for the small size are formed with the same width (w1=w2) but with materials of different resistivities so as to obtain approximately the same resistance between the electrodes. More specifically, the resistance material used for the heat generating member h1 for the large size has a resistivity lower than that of the heat generating member h2 for the small size.

In the configuration of the comparative example shown in FIG. 9, if the width w1 of the heat generating member for the large size is selected to be equal to that w2 of the heat generating member for the small size (w2=w1) and if the length L2 of the heat generating member for the small size is selected as ½ of that L1 of the heat generating member for the large size, the resistance of the former becomes ½ of that of the latter for the same resistivity, so that the heat generating member h2 generates a doubled power. The power supply device becomes bulky in order to compensate for such increased power, which also results in the drawback of the flickering phenomenon.

Figure 13:
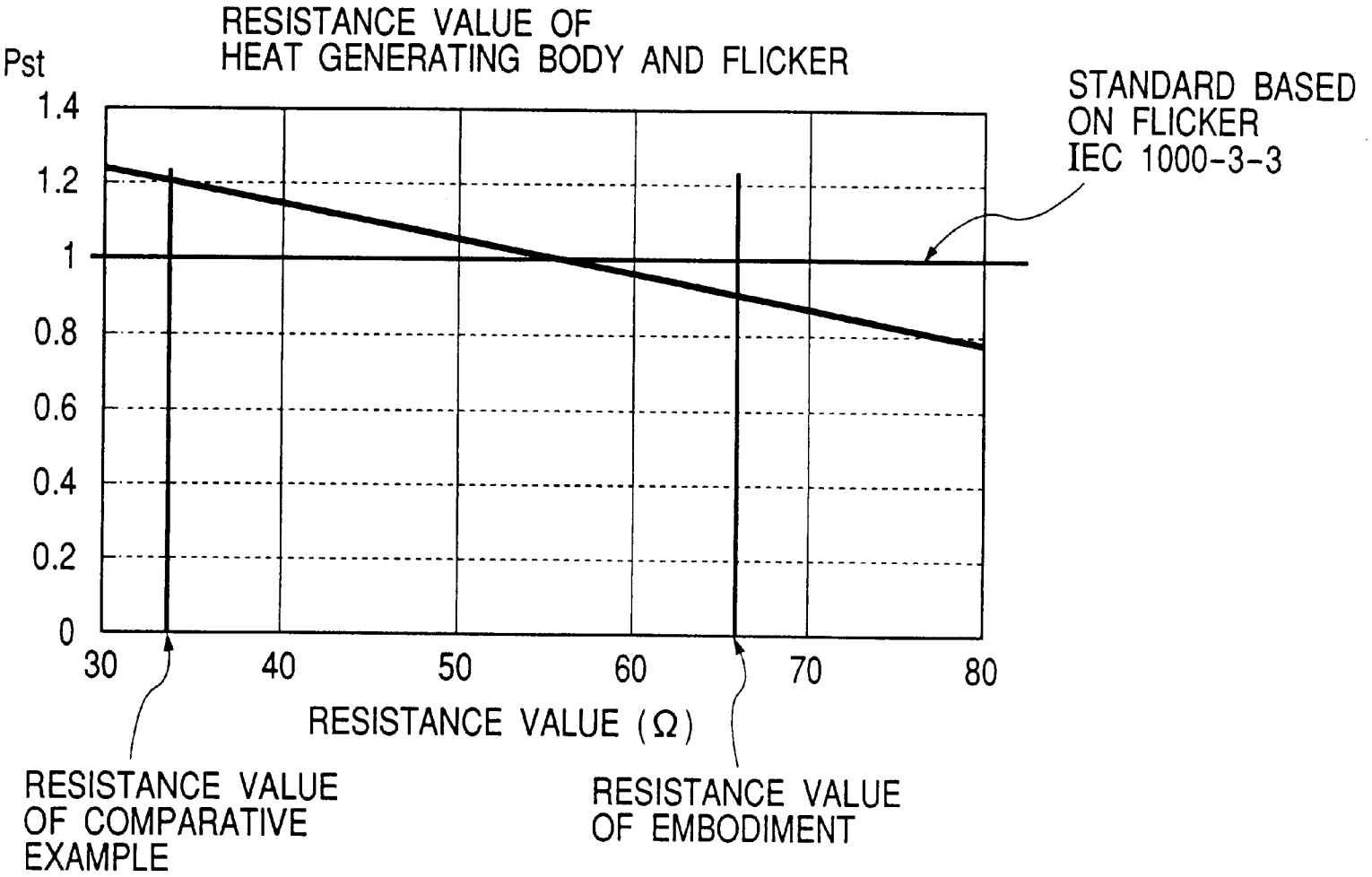
FIG. 13 is a chart showing flicker as a function of resistance value.
Figure 17:
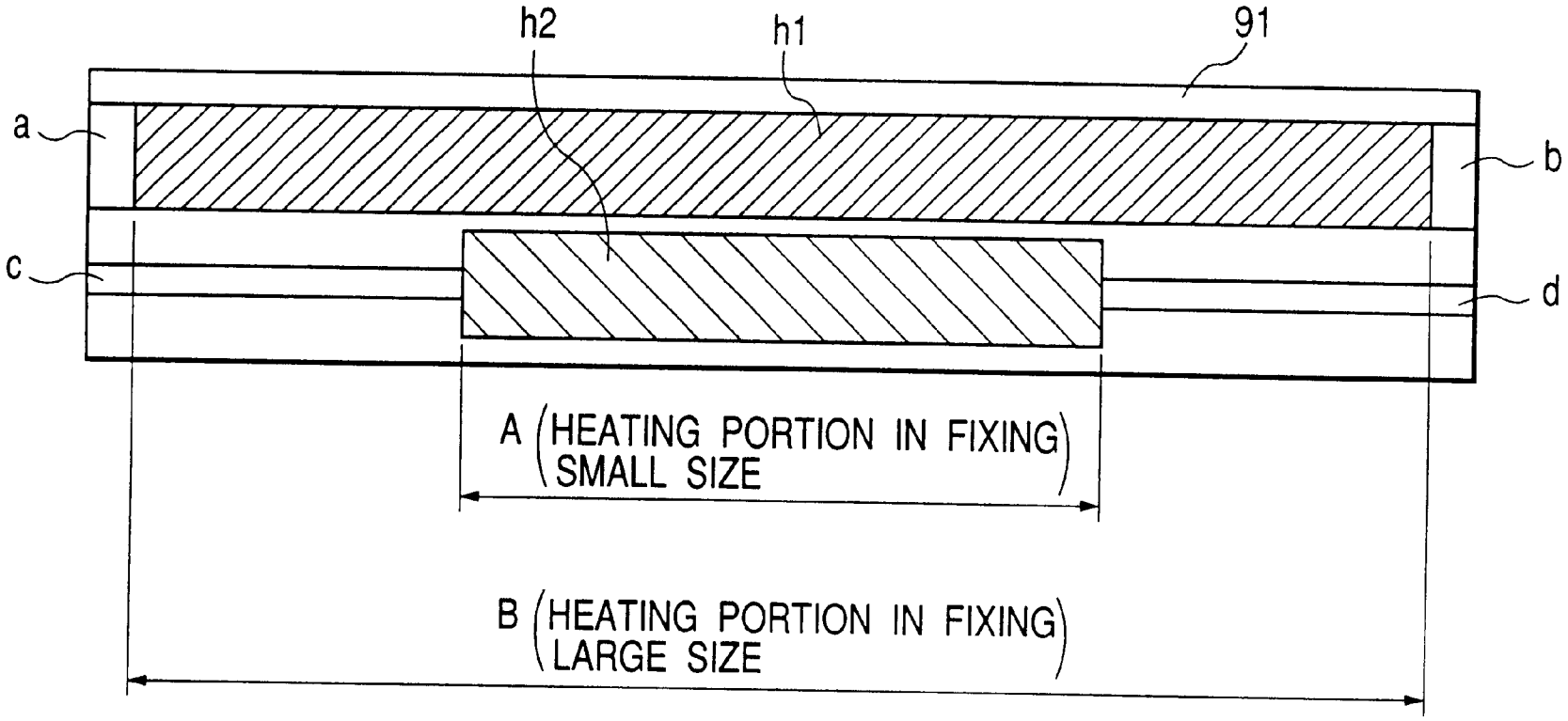
FIG. 17 is a view showing an image forming apparatus in which the present invention is applicable.

FIG. 13 shows the relationship between the resistance of the heat generating member and the flicker (Pst), measured by printing an evaluation pattern on a recording material of letter size (longitudinal dimension of 216 mm) on a printer of a printing speed of 16 sheet/min with a recording material conveying speed of 94.2 mm/sec and fixing the image with the heat generating member h1 for the large size, controlled at 200° C. In the fixing apparatus, the input voltage to the heater was AC 230V/50 Hz with frequency control. The flicker Pst has to be 1.0 or less under the European standard IEC 1000-3-3, but is in the acceptable range in the present embodiment as shown in FIG. 13, as the resistances of the heat generating members h1, h2 for the large and small sizes are about 67 Ω. On the other hand, in a comparative example shown in FIG. 17, having a heat generating member h1 for the large size of a length B (222 mm) and a resistance of 67 Ω and a heat generating member h2 for the small size of the same width and the same resistivity having a length A of 111 mm, the resistance becomes about 34 Ω so that the flicker becomes unacceptable in the fixation of the small-sized recording sheet.

As explained in the foregoing, the present embodiment allows suppression of the power consumption in the heat generating member for the small size in the fixation of a small-sized recording sheet, thereby preventing the flicker drawback. Also in passing the small-sized sheet, the shorter heat generating member h2 is activated, so that the temperature rise in the sheet non-passing area can be prevented in passing the small-sized sheets without increasing the internal thereof, and there can be prevented damages in the related components such as the fixing film or the pressure roller. Also even in the case of passing a large-sized recording sheet after passing the small-sized recording sheets, satisfactory fixing performance can be obtained without hot offset phenomenon at the ends of the recording sheet.

In the present embodiment, the resistances of the heat generating members for the large and small sizes are made substantially the same by employing different resistivities therein, but the substantially same resistances may also be obtained by varying the coating quantity (thickness) of the resistance material. Also the resistances need not necessarily be exactly the same but may be arbitrarily selected within a range not causing the flicker drawback.

Figure 14A:
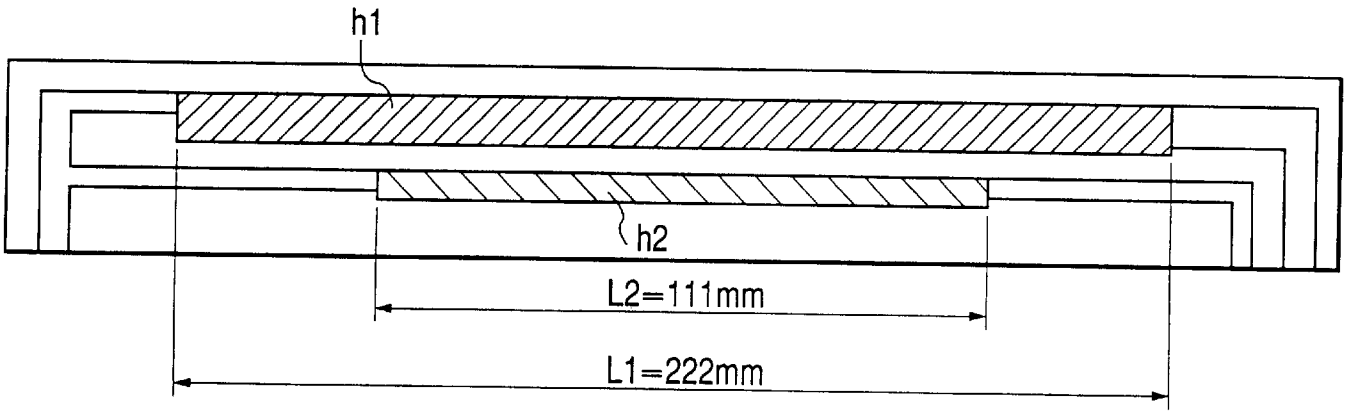
FIGS. 14A and 14B are views showing the arrangement of heat generating members on the heater.
Figure 14B:
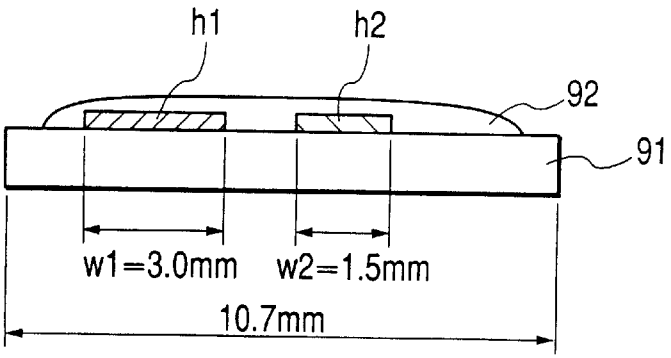

FIGS. 14A and 14B show still another embodiment of the heater of the present invention.

In the present embodiment, the longitudinal length and the width are suitably selected in the heat generating member h1 for the large size and in h2 for the small size.

More specifically, length L1 and width w1 of the heat generating member h1 and length L2 and width w2 of the heat generating member h2 are so selected as to satisfy a relation:

$$(w2/w1)/(L2/L1) \leqq 1.$$

Under the above-mentioned relation, the resistance of the heat generating member for the small size is at least equal to that of the heat generating member for the large size, so that power consumed in the heat generating member for the small size never exceeds that consumed in the heat generating member for the large size. Consequently it is not necessary to employ a bulky power supply device, and the flicker phenomenon is no longer a problem.

The heat generating member is generally formed by coating a paste with a screen and firing of the paste. As the resistance of the heat generating member varies in such process, it becomes difficult to manage the resistance of the heat generating member if such coating and firing are repeated.

The present embodiment facilitates management of the resistance and allows formation of the heat generating member h1 for the large size and the heat generating member h2 for the small size with appropriately selected resistances, since the plural heat generating members can be simultaneously coated and fired. Also the heat generating members of such configuration with independent control of the heat generating members according to the size of the recording material allow satisfactory fixing performance without excessive temperature rise in the sheet non-passing area.

In particular, the fixation of the large-sized sheet is efficient because the width w1 of the heat generating member for the large size is made larger than that w2 of the heat generating member for the small size. Also, when the heat generating member h2 for the small size is powered, the entire resistance thereof is equal to or higher than that of the heat generating member for the large size, thereby suppressing the power generated by the heat generating member for the small size and avoiding the electric noises such as flicker.

Also, in the case where different widths are changed, the heat generating members h1, h2 for the large and small sizes can be formed with the same material and can be simultaneously coated and fired, whereby the heater is advantageous in improving the productivity and reducing the manufacturing cost.

Furthermore, the heater need not be provided with two heat generating resistors but may be provided with three or more resistors.

Furthermore, the insulating substrate 91 need not be composed of aluminum nitride but may be composed of other ceramic materials such as aluminum oxide (alumina) or silicon carbide.

Furthermore, the pressurizing member 80 need not be composed of a roller but may assume other forms such as a belt.

Furthermore, the heating apparatus of the present invention includes not only the heat fixing apparatus but also means and apparatus for thermally treating a material, such as an image heating apparatus for improving the surface property such as gloss by heating a recording sheet bearing an image thereon, an image heating apparatus for temporary fixing of an image, a heat drying apparatus for a material, or a heat laminating apparatus.

It is furthermore possible to incorporate various improvements for realizing a higher process speed in the image forming apparatus, such as an increase in the rotation speed of the pressure roller and the fixing film by increasing the power of the driving motor, combined with a higher fixing temperature or a widened heating area achieved by an increased pressure of the pressure roller or a heater substrate or a fixing film with a higher thermal conductivity, so as to supply the sheet with sufficient thermal energy within the shortened passing time.

The present invention has been explained by preferred embodiments thereof, but the present invention is by no means limited by such embodiments and is subject to any and all modifications within the scope and spirit of the appended claims.

What is claimed is:

1. An image heating apparatus comprising:

a heater, said heater comprising a long-shaped heat-conductive substrate and plural heat generating members provided on a same surface of said substrate and adapted to generate heat by a power supply, wherein said plural heat generating members have respectively different distributions of heat generation in a longitudinal direction of said substrate; and a film that moves while a surface of said film is slid on said heater and another surface thereof contacts a recording material bearing an image;

wherein the image on the recording material is heated by heat from said heater via said film, and a surface of said heater on a side of a surface opposed to a surface of said substrate, on which said heat generating members are provided, contacts said film.

2. An image heating apparatus according to claim 1, wherein said substrate is composed of aluminum nitride.

3. An image heating apparatus according to claim 1, wherein one of said plural heat generating members is supplied power for a recording material of a first size while another is supplied power for a recording material of a second size smaller than said first size, and said plural heat generating members can image-heat a recording material of a third size between said first and second sizes.

4. An image heating apparatus according to claim 1, wherein said plural heat generating members are independently controlled for power supply.

5. An image heating apparatus comprising:

a heater, said heater comprising a long-shaped substrate, plural heat generating members provided on said substrate and adapted to generate heat by a power supply, a high heat-conductive member provided on said heat generating members, wherein said plural heat generating members have respectively different distributions of heat generation in a longitudinal direction of said substrate; and a film that moves while a surface of said film is slid on said heater and another surface thereof contacts a recording material bearing an image;

wherein the image on the recording material is heated by heat from said heater via said film; and said high heat-conductive member contacts said film, and said high heat-conductive member is composed of a metal, aluminum nitride or silicon carbide.

6. An image heating apparatus according to claim 5, wherein one of said plural heat generating members is supplied power for a recording material of a first size while another is supplied power for a recording material of a second size smaller than said first size, and said plural heat generating members can image-heat a recording material of a third size between said first and second sizes.

7. An image heating apparatus comprising:

a heater, said heater comprising a substrate and first and second heat generating members provided on said substrate and adapted to generate heat by a power supply;

a pair of electrodes provided on each of said first and second heat generating members respectively for supplying power; and a film that moves while a surface of said film is slid on said heater and another surface thereof contacts a recording material bearing an image;

wherein the image on the recording material is heated by heat from said heater via said film, and a length from one electrode to the other electrode of said second heat generating member is smaller than that of said first heat generating member, and a resistance value per unit length of said second heat generating member in a power supply direction directing from one electrode to the other electrode is larger than that of said first heat generating member.

8. An image heating apparatus according to claim 7, wherein a width of said second heat generating member in a direction perpendicular to said power supply direction is smaller than that of said first heat generating member.

9. An image heating apparatus according to claim 7, wherein a resistivity of said second heat generating member is larger than that of said first heat generating member.

10. An image heating apparatus according to claim 7, wherein said first heat generating member is supplied power for a recording material of a first size while said second heat generating member is supplied power for a recording material of a second size smaller than said first size.

11. An image heating apparatus according to claim 7, wherein said first and second heat generating members are independently controlled for power supply.

12. A heater comprising:

a substrate;

a first heat generating member and a second heat generating member provided on said substrate and adapted to generate heat by a power supply; and a pair of electrodes provided on each of said first and second heat generating members respectively for supplying power;

wherein a length from one electrode to the other electrode of said second heat generating member is smaller than that of said first heat generating member, and a resistance value per unit length of said second heat generating member in a power supply direction directing from one electrode to the other electrode is larger than that of said first heat generating member.

13. A heater according to claim 12, wherein a width of said second heat generating member in a direction perpendicular to said power supply direction is smaller than that of said first heat generating member.

14. A heater according to claim 12, wherein a resistivity of said second heat generating member is larger than that of said first heat generating member.

15. A heater according to claim 12, wherein said first heat generating member is supplied power for a recording material of a first size while said second heat generating member is supplied power for a recording material of a second size smaller than said first size.

16. A heater according to claim 12, wherein said first and second heat generating members are independently controlled for power supply.

17. An image heating apparatus according to claim 7, wherein said substrate is long-shaped and said first and second heat generating members are provided along a longitudinal direction of said substrate.

18. A heater according to claim 12, wherein said substrate is long-shaped and said first and second heat generating members are provided along a longitudinal direction of said substrate.

* * * * *

UNITED STATES PATENT AND TRADEMARK OFFICE

CERTIFICATE OF CORRECTION

PATENT NO. : 6,423,941 B1
DATED : July 23, 2002
INVENTOR(S) : Kenji Kanari et al.

It is certified that error appears in the above-identified patent and that said Letters Patent is hereby corrected as shown below:

Column 3,
Line 32, “of” should read -- of the --.

Column 7,
Line 49, “to reduce” should read -- reduction of --.

Column 8,
Line 2, “of” should be deleted.
Line 14, “of” (second occurrence) should be deleted.
Line 19, “which” should read -- which the --.
Line 60, “achievement” should read -- achievement of --.

Column 10,
Line 55, “preferably-does” should read -- preferably does --.

Column 19,
Line 26, “nal” should read -- val --.

Column 21,
Line 31, “film;” should read -- film, --.

Signed and Sealed this

Twenty-seventh Day of May, 2003

JAMES E. ROGAN
*Director of the United States Patent and Trademark Office*